US011560757B2

(12) United States Patent
Pray et al.

(10) Patent No.: US 11,560,757 B2
(45) Date of Patent: Jan. 24, 2023

(54) RELEASE MECHANISM FOR A WHIPSTOCK

(71) Applicant: Weatherford Technology Holdings, LLC, Houston, TX (US)

(72) Inventors: Jeffery Scott Pray, Shenandoah, TX (US); Michael Smalley, Houston, TX (US); Joshua Matthew Korf, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 21 days.

(21) Appl. No.: 17/148,826

(22) Filed: Jan. 14, 2021

(65) Prior Publication Data

US 2021/0131185 A1 May 6, 2021

Related U.S. Application Data

(62) Division of application No. 16/220,531, filed on Dec. 14, 2018, now Pat. No. 10,934,780.

(51) Int. Cl.
*E21B 7/06* (2006.01)
*E21B 23/04* (2006.01)

(52) U.S. Cl.
CPC ..... *E21B 7/061* (2013.01); *E21B 23/04* (2013.01)

(58) Field of Classification Search
CPC ..... E21B 23/04; E21B 23/08; E21B 7/061
See application file for complete search history.

(56) References Cited

U.S. PATENT DOCUMENTS

| | | | | |
|---|---|---|---|---|
| 2,506,799 | A | 5/1950 | Livingston | |
| 2,553,874 | A * | 5/1951 | Spaulding | E21B 7/061 175/325.2 |
| 2,567,507 | A | 9/1951 | Brown | |
| 2,770,444 | A | 11/1956 | Neal | |
| 2,823,012 | A | 2/1958 | Hanna | |
| 2,839,270 | A | 6/1958 | McCune et al. | |
| 2,978,032 | A | 4/1961 | Hanna | |
| 3,000,440 | A | 9/1961 | Malcomb | |
| 3,115,935 | A | 12/1963 | Hooton | |
| 3,194,327 | A | 7/1965 | Smithson | |
| 3,215,204 | A | 11/1965 | Sims | |

(Continued)

FOREIGN PATENT DOCUMENTS

| | | |
|---|---|---|
| CA | 2705595 A1 | 10/1999 |
| RU | 2469172 C1 | 12/2012 |

(Continued)

OTHER PUBLICATIONS

Korf et al.; Retention System for Bottom Hole Assembly and Whipstock; U.S. Appl. No. 15/730,455 filed Oct. 11, 2017.

(Continued)

*Primary Examiner* — Caroline N Butcher
(74) *Attorney, Agent, or Firm* — Cabello Hall Zinda, PLLC

(57) ABSTRACT

A bottom hole assembly (BHA) includes a whipstock having a latch release mechanism and a milling tool having a plurality of blades and a lock mechanism. The BHA also includes a collar coupled to the whipstock and disposed about a portion of the milling tool, wherein the blades of the milling tool abut the collar. The milling tool is releasably coupled to the whipstock by the interaction of the latch release mechanism and the lock mechanism.

20 Claims, 28 Drawing Sheets

(56) References Cited

U.S. PATENT DOCUMENTS

| | | | |
|---|---|---|---|
| 3,339,636 | A | 9/1967 | Frisby |
| 3,477,524 | A | 11/1969 | Marks, Jr. |
| 3,799,009 | A | 3/1974 | Guier |
| 4,284,136 | A | 8/1981 | Grabe |
| 4,928,767 | A | 5/1990 | Jelsma |
| 4,984,632 | A | 1/1991 | Sampa et al. |
| 5,467,819 | A | 11/1995 | Braddick |
| 5,533,573 | A | 7/1996 | Jordan, Jr. et al. |
| 5,678,634 | A | 10/1997 | Rehbock et al. |
| 5,771,972 | A | 6/1998 | Dewey et al. |
| 5,816,324 | A | 10/1998 | Swearingen et al. |
| 5,894,889 | A | 4/1999 | Dewey et al. |
| 6,102,123 | A | 8/2000 | Bailey et al. |
| 6,302,198 | B1 | 10/2001 | Ritorto et al. |
| 6,318,466 | B1 | 11/2001 | Ohmer et al. |
| 6,374,918 | B2 | 4/2002 | Roberts et al. |
| 6,464,002 | B1 | 10/2002 | Hart et al. |
| 6,591,905 | B2 | 7/2003 | Coon |
| 6,695,056 | B2 | 2/2004 | Haugen et al. |
| 6,910,538 | B2 | 6/2005 | Tinker |
| 6,939,073 | B1 | 9/2005 | Ahmed et al. |
| 6,968,903 | B2 | 11/2005 | Pollard |
| 7,083,010 | B2 | 8/2006 | Eppink et al. |
| 7,201,529 | B2 | 4/2007 | Lejeune |
| 7,264,059 | B2 | 9/2007 | Akselberg |
| 7,353,867 | B2 | 4/2008 | Carter et al. |
| 7,487,837 | B2 | 2/2009 | Bailey et al. |
| 7,699,112 | B2 | 4/2010 | Galloway |
| 7,878,253 | B2 | 2/2011 | Stowe et al. |
| 7,963,341 | B2 | 6/2011 | Rios, III et al. |
| 8,327,944 | B2 | 12/2012 | King et al. |
| 8,469,096 | B2 | 6/2013 | McGarian |
| 8,833,442 | B2 | 9/2014 | Ibragimov et al. |
| 9,004,159 | B2 | 4/2015 | Alsup et al. |
| 10,704,328 | B2 | 7/2020 | Korf et al. |
| 2002/0170713 | A1* | 11/2002 | Haugen ..... E21B 17/07 166/117.6 |
| 2003/0213599 | A1 | 11/2003 | Tinker |
| 2006/0108119 | A1* | 5/2006 | Bailey ..... E21B 33/085 166/344 |
| 2009/0139724 | A1 | 6/2009 | Gray et al. |
| 2010/0012322 | A1* | 1/2010 | McGarian ..... E21B 7/061 166/298 |
| 2014/0332277 | A1 | 11/2014 | Churchill |
| 2016/0238055 | A1 | 8/2016 | Donovan |
| 2017/0089177 | A1 | 3/2017 | Xu et al. |
| 2019/0003264 | A1* | 1/2019 | Swadi ..... E21B 17/02 |

FOREIGN PATENT DOCUMENTS

| | | | |
|---|---|---|---|
| WO | 2002/44509 | A2 | 6/2002 |
| WO | 2015053760 | A1 | 4/2015 |
| WO | 2016209686 | | 12/2016 |

OTHER PUBLICATIONS

Invitation to Pay Additional Fees and Communication Relating to Partial International Search in related application PCT/US2019/057703 dated Jan. 3, 2020.

International Search Report and Written Opinion in related application PCT/US2019/057703 dated Feb. 25, 2020.

European Search Report in related application EP 22154631.0 dated Mar. 30, 2022.

Canadian Examiner Report in related application CA 3,118,858 dated Aug. 2, 2022.

* cited by examiner

RELEASE MECHANISM FOR A WHIPSTOCK

CROSS-REFERENCE TO RELATED APPLICATIONS

This Application is a Division of application Ser. No. 16/220,531, filed on Dec. 14, 2018. The aforementioned patent application is herein incorporated by reference in its entirety.

BACKGROUND

Field

Embodiments of the disclosure relate to a releasable connection between a whipstock and a downhole tool. Embodiments of the disclosure relate to improved axial and torsional load transfer between a whipstock and a milling tool.

Description of Related Art

It is known in the oil and gas industry to attach a whipstock to a milling tool by a shearable member for deployment into a wellbore. Once the whipstock is in a desired location in the wellbore, an axial load is applied to shear the shearable member and thus separate the milling tool from the whipstock. The shearable attachment between the whipstock and milling tool can be unintentionally sheared if an unexpected obstruction is encountered in the wellbore or during extended reach operations in horizontal wellbores where friction forces are high. During an anchor test, the shearable member is prone to shearing, thereby resulting in the need to remove the whipstock and then initiate a separate retrieval operation to remove the anchor from the wellbore if the anchor fails the test. The shearable members are prone to inadvertent shearing if a torsional load is transferred between the milling tool and the whipstock, such as an operation to orientate a whipstock in a certain direction in the wellbore.

There is a need for a releasable connection between a whipstock and downhole tool that will release on command while not inadvertently shearing by the application of a torsional or axial load.

SUMMARY

In an embodiment, a latch release mechanism includes a housing having a fluid inlet, an actuator piston, a latch member, and a switch. The actuator piston is at least partially disposed in the housing and movable from a first positon to a second position in response to fluid communication from the fluid inlet. The latch member is coupled to the actuator piston and movable from a first positon to a second position by the actuator piston. The switch has a first configuration, a second configuration, and an intermediate configuration, wherein fluid communication is blocked when the switch is in the first configuration and the intermediate configuration, and wherein the fluid communication is unblocked when the switch is in the second configuration. The actuator piston is movable to the second position when the switch is in the second configuration.

In one embodiment, an assembly for use downhole includes an actuator and a switch assembly. The switch assembly has an inlet in selective fluid communication with the actuator, and a switch having a first configuration, an intermediate configuration, and a second configuration. The switch blocks fluid communication between the inlet and the actuator when in the first configuration and the intermediate configuration, and wherein the switch allows fluid communication between the inlet and the actuator when in the second configuration.

In one embodiment, a bottom hole assembly (BHA) has a whipstock, a downhole tool having a lock mechanism, and a latch release mechanism attached to the whipstock and configured to releasably attach the whipstock to the downhole tool. The latch release mechanism has an actuator piston, a switch, and a latch member. The actuator piston is movable from a first position to a second position in response to fluid communication. The switch having a first configuration, a second configuration, and an intermediate configuration, wherein fluid communication is blocked when the switch is in the first configuration and the intermediate configuration, and wherein the fluid communication is unblocked when the switch is in the second configuration. The latch member is coupled to the piston and configured to engage the lock mechanism in a first positon and to disengage from the lock mechanism in a second position, wherein the latch member is movable from the first position to the second position by the actuator piston when the switch is in the second configuration.

In one embodiment of a method of releasing a whipstock from a downhole tool includes running a BHA having the whipstock releasably attached to the downhole tool into a wellbore. The whipstock has a latch release mechanism and the downhole tool has a lock mechanism, and a latch member of the latch release mechanism is engaged with a locking member of the lock mechanism. The method further includes converting a switch of the latch release mechanism from a first configuration to a second configuration to unblock a fluid communication between a fluid communication line and an actuator piston attached to the latch member. The method further includes releasing the whipstock from the downhole tool by moving the actuator piston coupled to the latch member to disengage the latch member from the locking member in response to the fluid communication in the fluid communication line.

In one embodiment, a BHA includes a whipstock having a latch release mechanism and a milling tool having a plurality of blades and a lock mechanism. The BHA further includes a collar coupled to the whipstock and disposed about a portion of the milling tool, wherein the blades of the milling tool abut the collar. The milling tool is releasably coupled to the whipstock by the interaction of the latch release mechanism and the lock mechanism.

BRIEF DESCRIPTION OF THE DRAWINGS

So that the manner in which the above recited features of the present disclosure can be understood in detail, a more particularized description of the disclosure, briefly summarized above, may be had in reference to embodiments, some of which are illustrated in the appended drawings. It is noted, however, that the appended drawings illustrate only the typical embodiments of this disclosure and are therefore not to be considered limiting in scope, for the disclosure may admit to other equally effective embodiments.

In FIG. 3A, the locking member of the lock mechanism is in the extended position. In FIG. 3B, the locking member of the lock mechanism is in the retracted position.

In FIG. 4A, the latch member is shown to be in a first position and engaged with the latch portion of the lock mechanism. In FIG. 4B, the latch actuator of the latch release mechanism is shown having a first switch in a first configuration, a second switch in a first configuration, and an actuator piston in a first position. In FIG. 4C, the latch actuator of the latch release mechanism is shown having the first switch in a second configuration. In FIG. 4D, the latch actuator of the latch release mechanism is shown having the second switch in an intermediate configuration. In FIG. 4E, the latch actuator of the latch release mechanism is shown having the second switch in a second configuration. In FIG. 4F, the latch actuator of the latch release mechanism is shown having the actuator piston in the second position. In FIG. 4G, the latch member is shown to be in a second position and disengaged with the latch portion of the lock mechanism. FIG. 4H illustrates an exemplary connection of the inlet of the latch actuator with the fluid communication line.

FIG. 5B is an enhanced view of the circled region in FIG. 5A and illustrates a cross-sectional view of the latch release mechanism.

FIG. 6A illustrates the connection mechanism disposed between an anchor and a whipstock. FIG. 6B illustrates a cross-section of the connection mechanism and shows the switch. FIG. 6C illustrates the switch in a first configuration. FIG. 6D illustrate the switch in a second configuration.

In FIG. 7A, the latch actuator and latch member of the latch release mechanism are shown, and the latch mechanism is further shown to be in a first positon such that it is in engagement with the latch portion of the lock mechanism. In FIG. 7B, the latch member is shown to be in the second positon such that the latch member is disengaged from the latch portion of the lock mechanism.

FIG. 9B is an enhanced view of the circled region in FIG. 9A and illustrates a cross-sectional view of the latch actuator and latch member of the latch release mechanism.

In FIG. 10A, the switch of the switch assembly is shown to be in a first configuration and an actuator piston of the actuator is shown to be in a first position. In FIG. 10B, the switch of the switch assembly is shown to be in an intermediate configuration. In FIG. 10C, the switch of the switch assembly is shown to be in a second configuration and the actuator piston of the actuator is shown to be in a second position.

DETAILED DESCRIPTION

Figure 1:
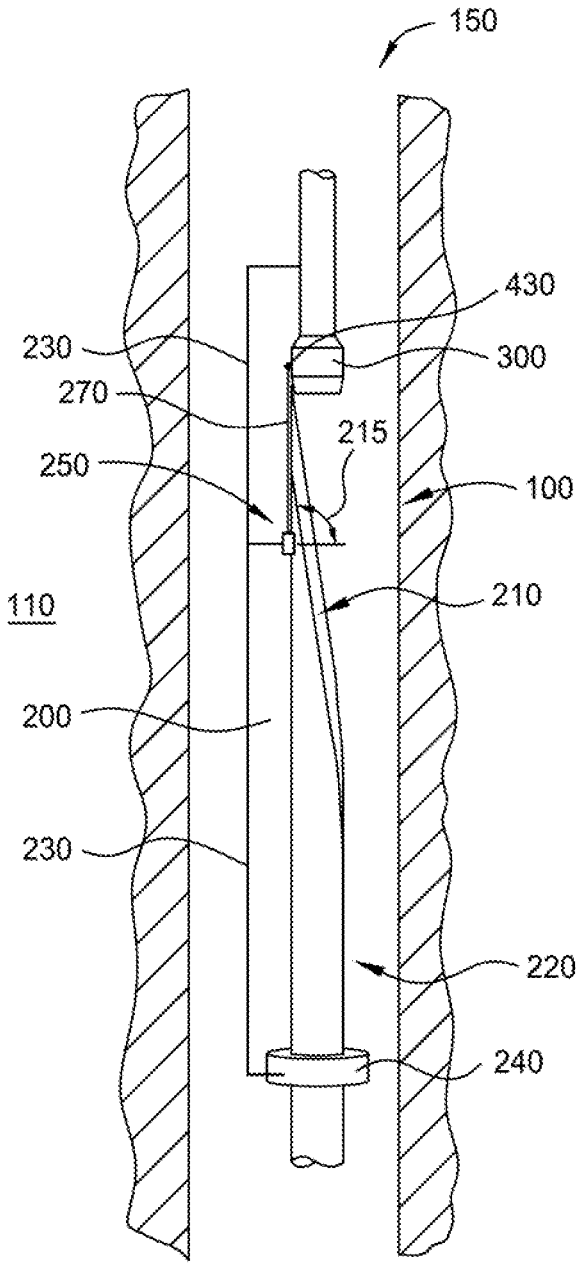
FIG. 1 illustrates a bottom hole assembly disposed in a subsurface formation, the BHA having a milling tool coupled to a whipstock with a latch release mechanism.

FIG. 1 illustrates a BHA 150 placed in a wellbore 100 within a subsurface formation 110, according to embodiments disclosed herein. The BHA 150 has a whipstock 200 releasably attached to a downhole tool 300, such as a milling tool. For example, the whipstock 200 may be attached to the downhole tool 300 by the interaction of a lock mechanism 400 of the downhole tool 300 with a latch release mechanism 250 of the whipstock 200, as will be discussed in greater detail below.

The whipstock 200 has a concave face 210, a body 220, and a latch release mechanism 250 coupled to the body 220. The whipstock 200 is attached to an anchoring mechanism 240, which secures the whipstock 200 in the wellbore 100. For example, the anchoring mechanism may include a packer, an inflatable anchor, a slip type anchor, or combinations thereof. In some embodiments, the body 220 is connected to an anchoring mechanism 240 for securing the whipstock 200 in the wellbore 100. In some embodiments, the anchoring mechanism 240 is integrated with the whipstock 200. For the purposes of this illustration, the whipstock 200 is not shown anchored to the wellbore 100 by the anchoring mechanism 240.

The concave face 210 is generally a curved surface. In some embodiments, the concave face 210 is a surface that is primarily flat. The concave face 210 may be most narrow at an upper end. The concave face 210 may be approximately cylindrical at a lower end. The body 220 may be generally cylindrical and extends from the lower end of the concave face 210. In some embodiments, the whipstock 200 has a fluid communication line 230 that is disposed on, or along at least a portion of the length of the concave face 210. In some embodiments, the fluid communication line 230 extends along at least a portion of the length of the body 220. In some embodiments, the fluid communication line 230 extends along both at least a portion of the length of the concave face 210 and at least a portion of the length of the body 220. In some embodiments, the fluid communication line 230 is disposed within the body 220 of the whipstock 200 and extends along at least a portion of the length of the body 220 and/or the concave face 210. In other embodiments, the fluid communication line 230 is only partially disposed within the body 220 of the whipstock and extends along at least a portion of the length of the body 220 and/or the concave face 210. The fluid communication line 230 may be fluidly connected to both the anchoring mechanism 240 and the latch release mechanism 250.

For operational purposes, it may be desirable to secure the whipstock 200 in wellbore 100 so that it is positioned at a particular depth. As illustrated in FIG. 1, wellbore 100 is shown as being vertical (i.e., generally parallel to gravitational force) in subsurface formation 110, but in many circumstances at least a portion of wellbore 100 will not be vertical. Nonetheless, as used herein, "depth" refers to a length along the wellbore 100 measured from the surface. The direction that is locally generally parallel to the wellbore may be referred to as the "axial" direction. Terms such as "up", "down", "top", "bottom", "upper," "lower," etc., should be similarly construed.

For operational purposes, it may be desirable to secure the whipstock 200 so that concave face 210 is oriented at a particular orientation relative to the wellbore 100. The concave face 210 has an angle 215 relative to wellbore 100. For example, the angle 215 between the center of curvature of the upper end of concave face 210 and the wellbore 100 may help to determine the bit path direction/trajectory during subsequent drilling operations. The angle 215 may be expressed, for example, as a compass measurement or with reference to a clock face.

Figure 2A:
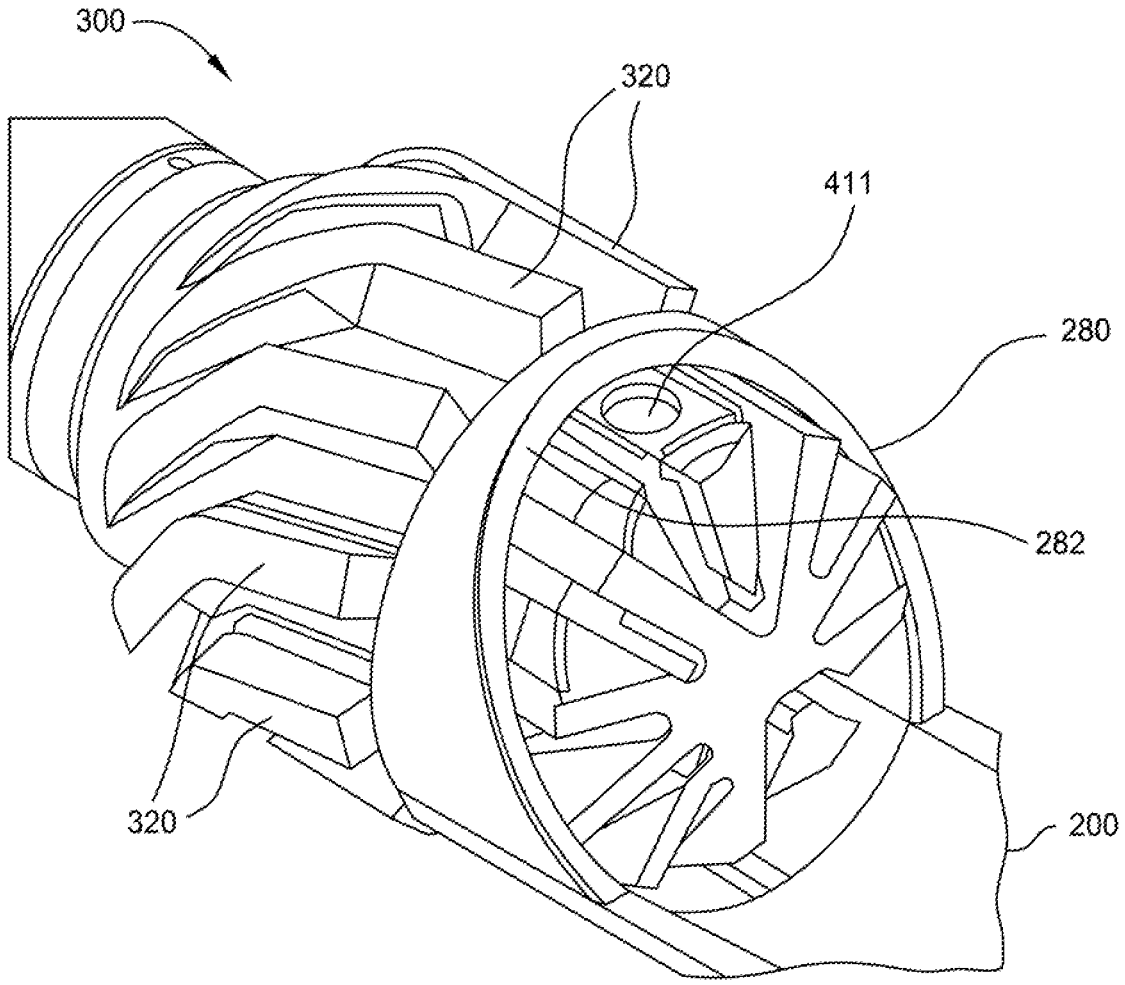
FIG. 2A illustrates an exemplary configuration of the milling tool of the BHA engaged with a collar attached to the whipstock.

FIG. 2A illustrates a collar 280 attached to one end of the whipstock 200. The collar 280 may be a partial ring attached to the whipstock 200, such as by welding or a bolt attachment. In another example, the collar 280 is a full ring attached to the whipstock 200. The whipstock 200 may be manufactured such that the collar 280 is an integral feature. The collar may have a concave region 282. A face of the milling tool 300 may abut the collar 280. In another embodiment, the collar 280 abuts the lower portions of the blades 320 of the milling tool 300. The lower portions of the blades 320 abutting the collar 280, as shown in FIG. 2A, may be cutting faces of the blades 320. The collar 280 helps accommodate axial load placed on the whipstock 200 by the milling tool 300.

Figure 2B:
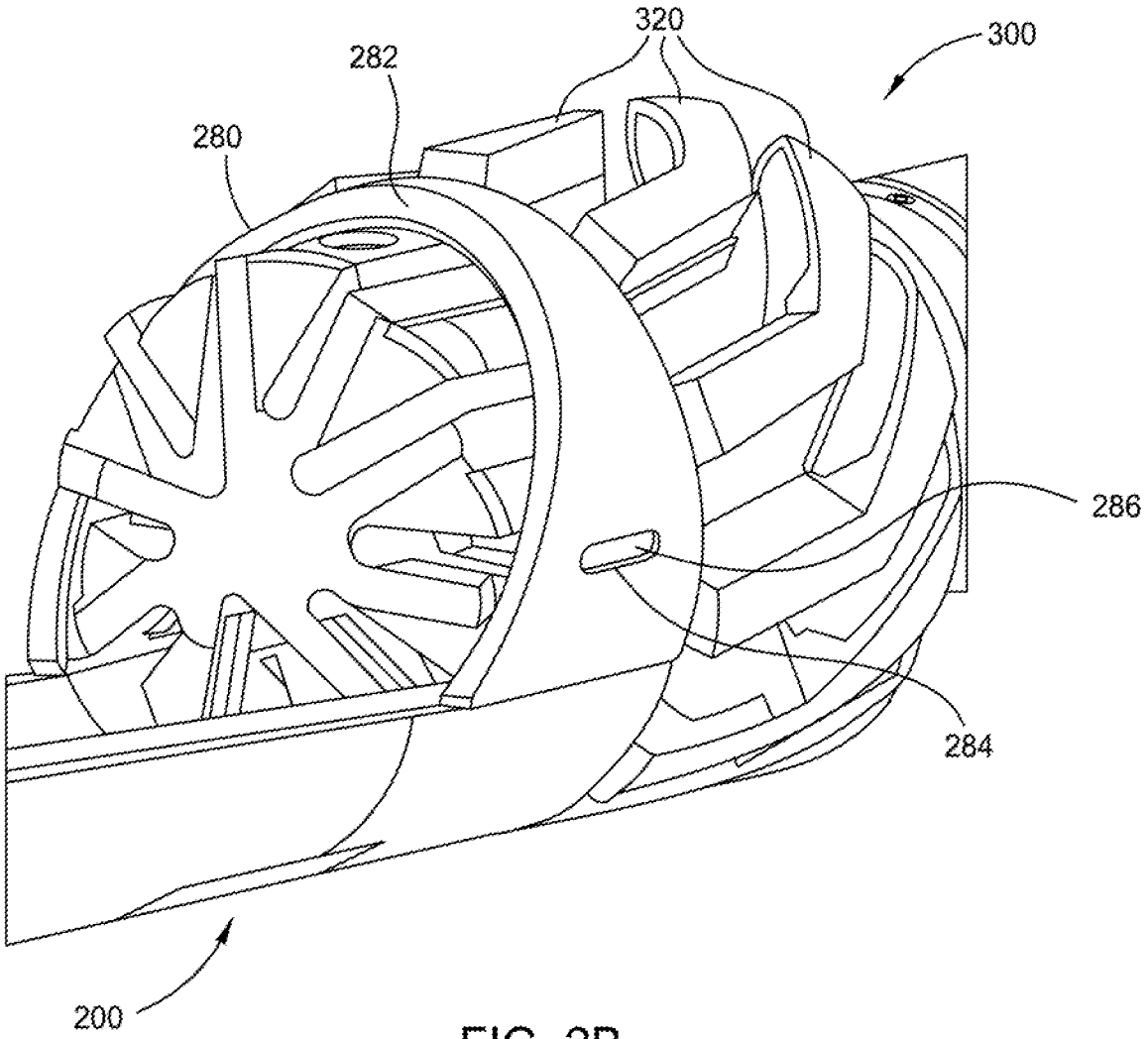
FIG. 2B illustrates another exemplary configuration of the milling tool engaged with a collar of the whipstock having a plurality of torque keys.
Figure 2C:
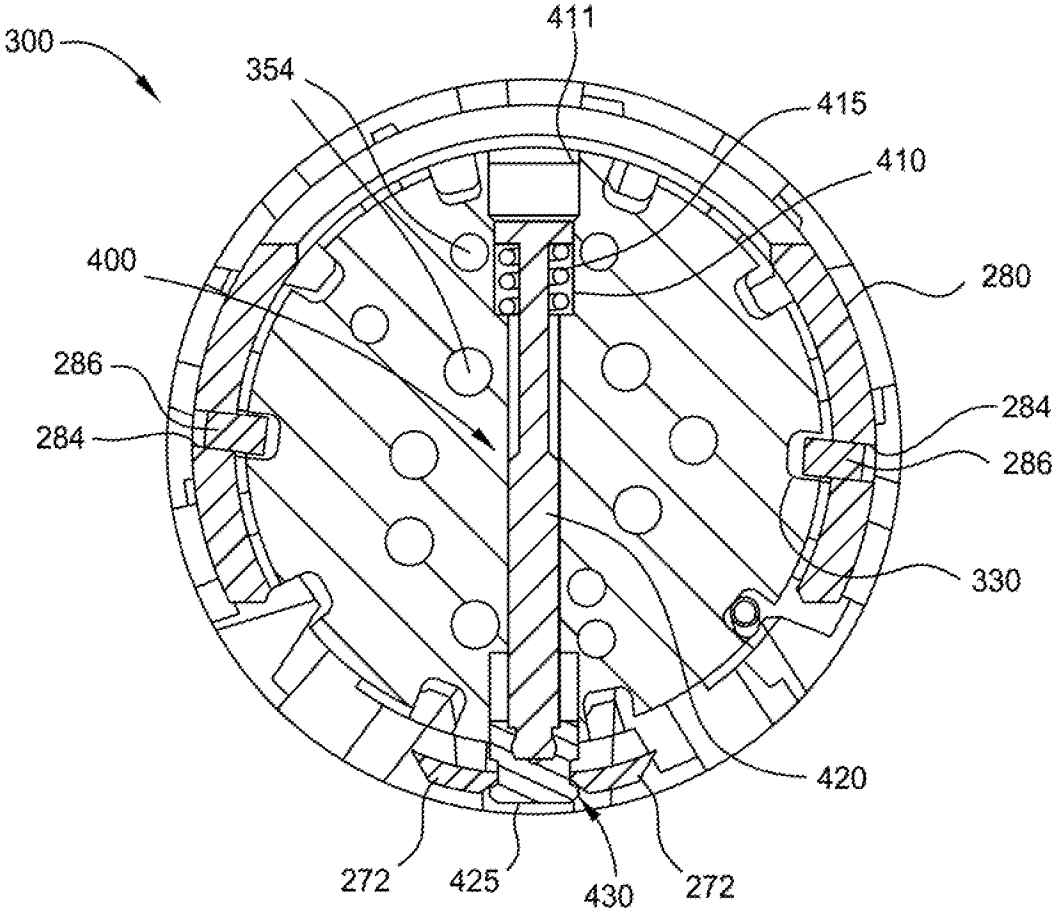
FIG. 2C is a cross section of the milling tool as shown in FIG. 2B and illustrates the lock mechanism.

FIG. 2B illustrates an alternative embodiment of the collar 280 having a plurality of apertures 284 in the collar 280 for retaining torque keys 286. As shown in FIG. 2A, collar 280 is disposed about a portion of the milling tool 300. As shown in FIG. 2C, the torque keys 286 are at least partially disposed in a corresponding recess 330 formed in the milling tool 300. In another example, the torque keys 286 are at least partially disposed between adjacent blades 320. The torque keys 286 allow the transfer of torque between the milling tool 300 and the whipstock 200. In another embodiment, instead of torque keys 286, a plurality of castellations in the collar 280 are engaged with a corresponding blade 320 of the milling tool to allow torque transfer between the milling tool 300 and the whipstock 200.

Figure 3A:
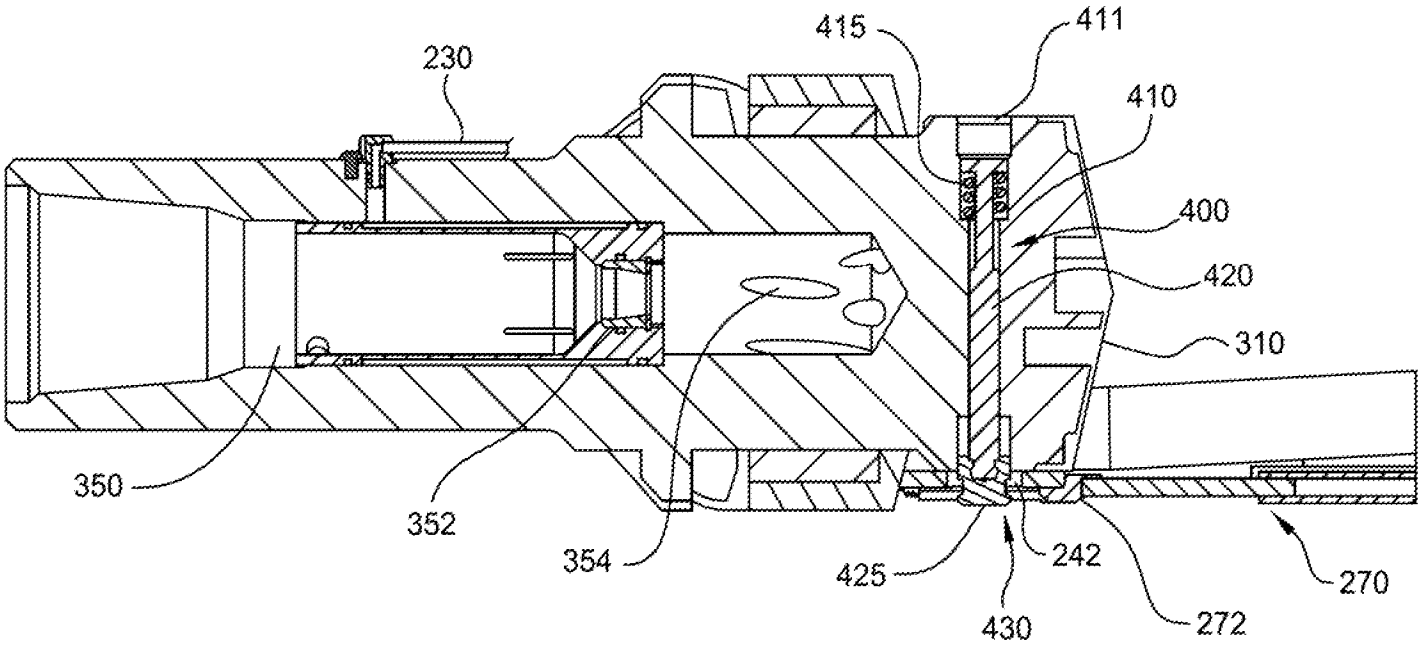
FIGS. 3A-3B illustrate an exemplary cross sectional view of the whipstock releasably attached to the milling tool.
Figure 3B:
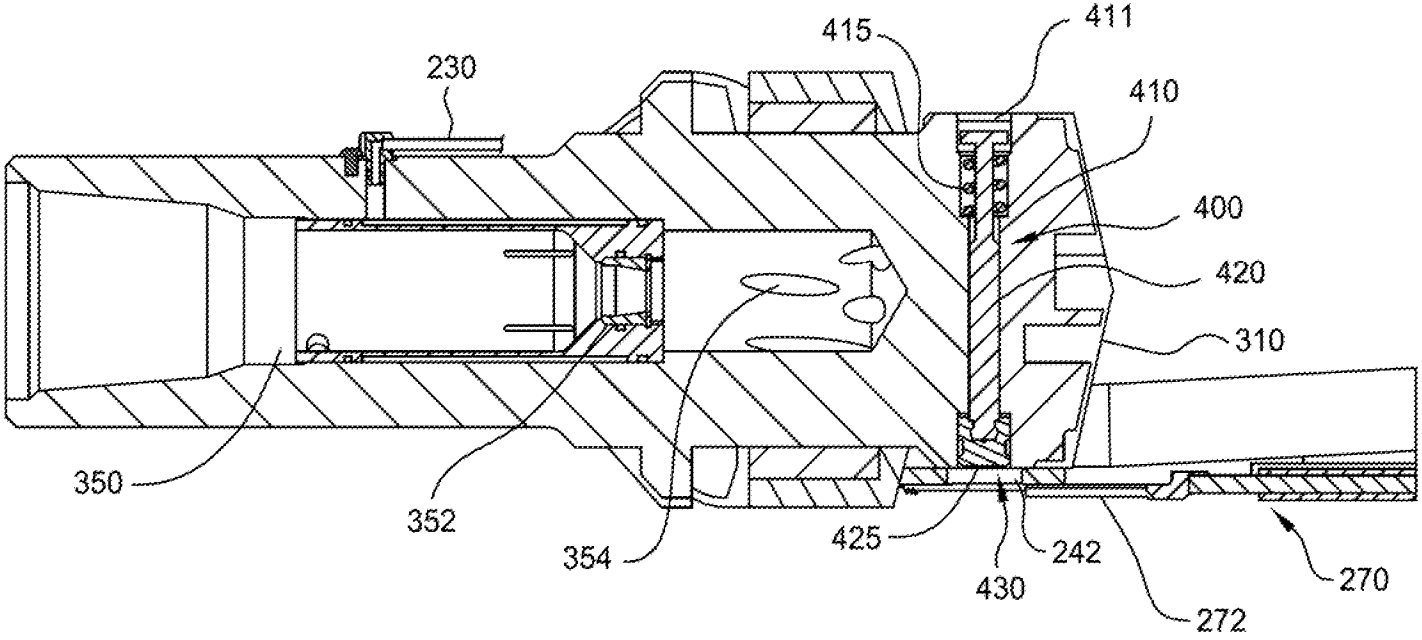

FIG. 3A-B illustrates the whipstock 200 releasably attached to the milling tool 300 of the BHA 150. In one embodiment, the milling tool 300 has a lock mechanism 400 disposed in the milling tool 300. As illustrated, a locking member 420 is disposed within a bore 410 of the milling tool 300. The bore 410 may be located proximate to mill face 310. FIG. 2C illustrates a cross-section view of the milling tool 300 showing the lock mechanism 400. The bore 410, as shown in FIG. 3, is generally perpendicular to the longitudinal axis of the milling tool 300, but in other embodiments, the bore 410 may be aligned at an angle relative to mill face 310. The bore 410 and locking member 420 are configured to allow the locking member 420 to move in the bore 410 between an extended positon, as shown in FIG. 3A, and a retracted position, as shown in FIG. 3B. In the extended position, a lower end 425 of the locking member 420 extends outside of the milling tool 300 and at least partially into an aperture 242 of the whipstock 200. In the retracted position, the end 425 of the locking member 420 does not extend outside of the milling tool 300. The locking member 420 is biased toward the retracted position by a biasing mechanism 415, such as a spring. In some embodiments, the bias mechanism 415 may be a magnet or a shape memory alloy. In some embodiments, the bias mechanism 415 may generate a biasing force by using mechanical, electromagnetic, chemical, hydraulic, or pneumatic components. In some embodiments, the biasing mechanism 415 may be located closer to a lower end 425 of the locking member 420.

In some embodiments, the milling tool 300 and whipstock 200 are torsionally coupled by the torque keys 286 and the aperture 242 is sized such that a gap is formed between the locking member 420 and the walls of the aperture 242 of the whipstock 200 when torsional loading is applied to the BHA 150 from the surface. For example, by providing a gap between the portion of the protruding locking member 420 and the whipstock 200, no torque applied to the milling tool 300 will be transferred to the locking member 420. Torque is transferred from the milling tool 300 to the whipstock 200 via the torque keys 286. Thus, the lock mechanism 400 is isolated from torsional loads applied to the whipstock 200 by the milling tool 300.

In some embodiments, the locking member 420 is not isolated from axial and torsional loads applied to the whipstock 200 by the milling tool. For example, the locking mechanism may contact the aperture 242 when axial or torsional loading is applied. For example, axial load may be applied to the locking member 420 if the BHA 150 is lifted or lowered within the well. The locking member 420 is configured to not inadvertently shear from the applied torsional and axial loads.

In some embodiments, the lock mechanism 400 includes a plurality of locking members 420, whereby each locking member protrudes into a corresponding aperture of a plurality of apertures 242 in the whipstock 200. In some embodiments, the locking member 420 may be shaped as a bolt, pin, a plate, fork, or otherwise shaped to meet manufacturing and/or operational specifications while providing a locking member function and a retraction action. The locking member 420, as shown in FIGS. 3A-3B is a pin. In some embodiments, the locking member 420 may have a circular, triangular, square, hexagonal, or other cross-sectional shape to meet manufacturing and/or operational specifications. In some embodiments, the locking member 420 may include a rigid, sturdy material, such as metal, alloy, composite, fiber, etc., to meet manufacturing and/or operational specifications. For example, the locking member 420 is configured to not inadvertently shear from applied torsional or axial loads during normal operation of the BHA 150.

In some embodiments, the milling tool 300 may have an installation aperture 411 coupled to bore 410. Prior to positioning BHA 150 in wellbore 100, installation aperture 411 may be utilized to install the locking member 420 and/or spring 415 in the bore 410 so that the locking member 420 is biased toward a retracted position. The concave region 282 of the collar 280 allows access to the installation aperture 411. The locking member 420 may move in the bore 410 between the retracted position and the extended position. As an example, the locking member 420 will not inadvertently fail thereby causing pre-mature release of the whipstock 200 from the milling tool 300 if an obstruction is encountered during run-in of the BHA 150 or during a test of the anchoring mechanism 240. In some embodiments, the lock mechanism 400 includes a plurality of locking members, wherein at least one of the plurality of locking members is a locking member 420 that moves without failure during planned operational conditions.

A latch portion 430 is disposed at one end of the locking member 420. When in the extended position, the latch portion 430 protrudes beyond the outer diameter of the milling tool 300. The latch portion 430 is configured to engage with the latch member 270 of the latch release mechanism 250 to attach the whipstock 200 to the milling tool 300. In one embodiment, the latch portion 430 includes a recess for engaging the latch member 270. In one embodiment, the latch portion 430 includes one recess on each side of the locking member 420 for engaging the latch member 270.

Figure 4A:
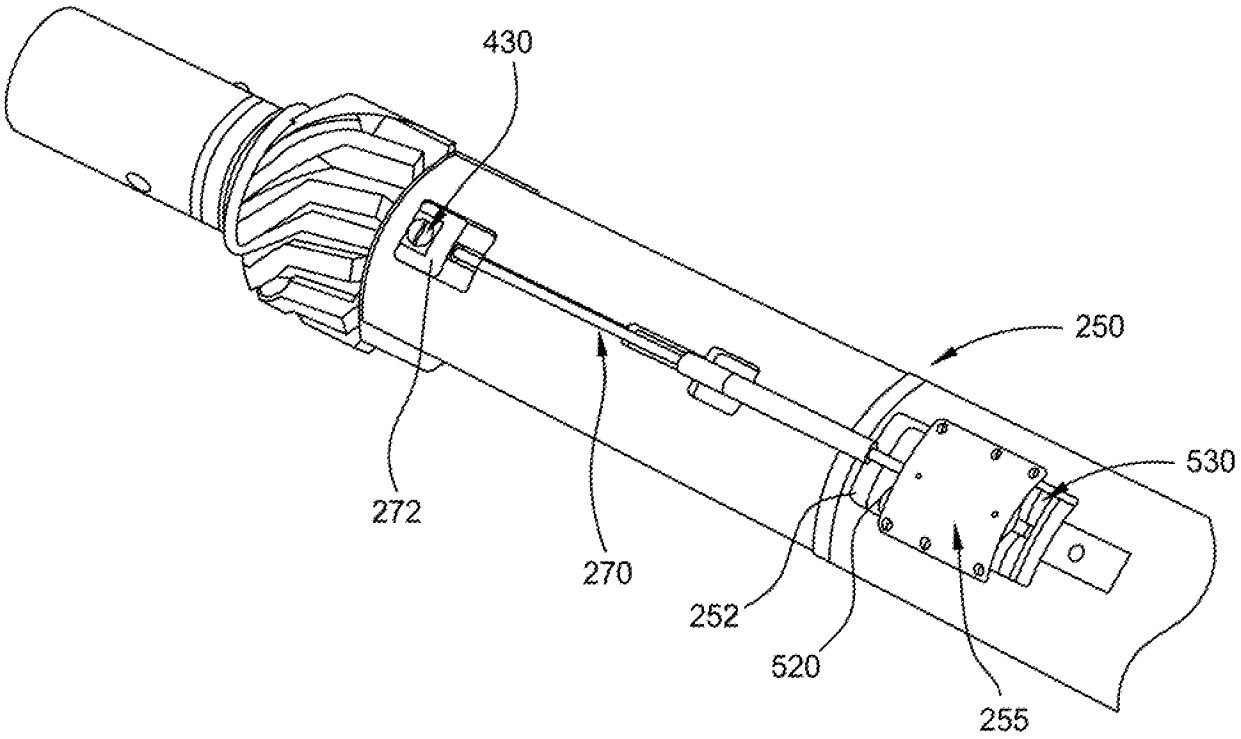
FIGS. 4A-4H illustrate an exemplary configuration of the whipstock releasably attached to the milling tool via the engagement of the latch release mechanism with the lock mechanism.

FIG. 4A illustrates another view of the BHA 150 with the latch member 270 of the latch release mechanism 250 engaged with the latch portion 430 of the lock mechanism 400 to retain the locking member 420 in the extended position. The latch release mechanism 250 includes the latch member 270 and a latch actuator 255 for moving the latch member 270. The latch actuator 255 is disposed in an aperture 252 of the whipstock 200 and may be affixed to the whipstock 200, such as by a screws or bolts inserted through mounting bores 513 formed in the housing 500 of the latch actuator 255.

The latch member 270 has a latch 272 attached at one end. The latch 272 of the latch member 270 is configured to engage with the latch portion 430 of the locking member 420. In one embodiment, the latch 272 includes a two-pronged fork configuration, as shown, that are inserted into the corresponding recess of the latch portion 430. In one embodiment, the latch 272 includes a two-pronged fork configuration that is inserted into two corresponding recesses of the latch portion 430. In an alternative embodiment, the latch portion 430 may comprise a bore through the locking member 420 and the latch 272 may comprise a portion of the latch member 270 sized to be inserted into bore forming the latch portion 430. As shown, the latch member 270 is a rod having an adjustable length with a latch 272 attached at one end. In another embodiment, the latch member 270 may be a rod having a fixed length with a latch 272 attached at one end. In another embodiment, the latch member 270 may be a cable having a latch 272 attached at one end.

Figure 4B:
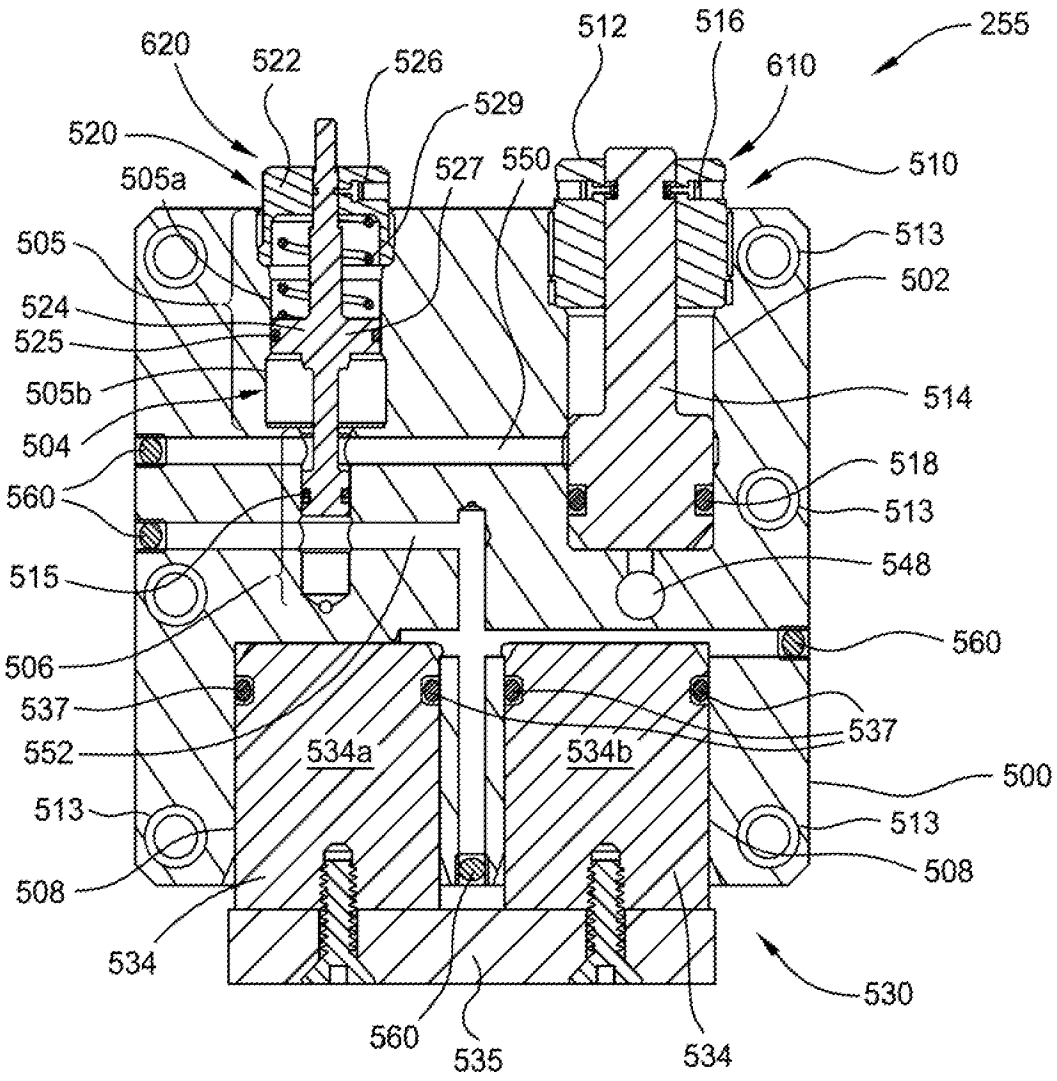

FIG. 4B illustrates a partial cross-sectional view of the latch actuator 255 of the latch release mechanism 250. The latch actuator 255 includes a housing 500, an inlet 548 coupled to the fluid communication line 230, a first switch 610, a second switch 620, and a third piston assembly 530 having an actuator piston 534. In one embodiment, the first switch 610 is a first piston assembly 510, and the second switch 620 is a second piston assembly 520. The first piston assembly 510 is at least partially disposed in a first piston assembly bore 502 of the housing 500. The second piston assembly 520 is at least partially disposed in the second piston assembly bore 504 of the housing 500. The third piston assembly 530 is at least partially disposed in the third piston assembly bore 508 of the housing. A fluid communication line 550 allows fluid communication between the first piston assembly bore 502 and the second piston assembly bore 504. Fluid communication line 552 allows for fluid communication between the second piston assembly bore 504 and the third piston assembly bore 508. A portion of the latch member 270 may be disposed within the housing 500 or within a channel formed in the housing.

Figure 4C:
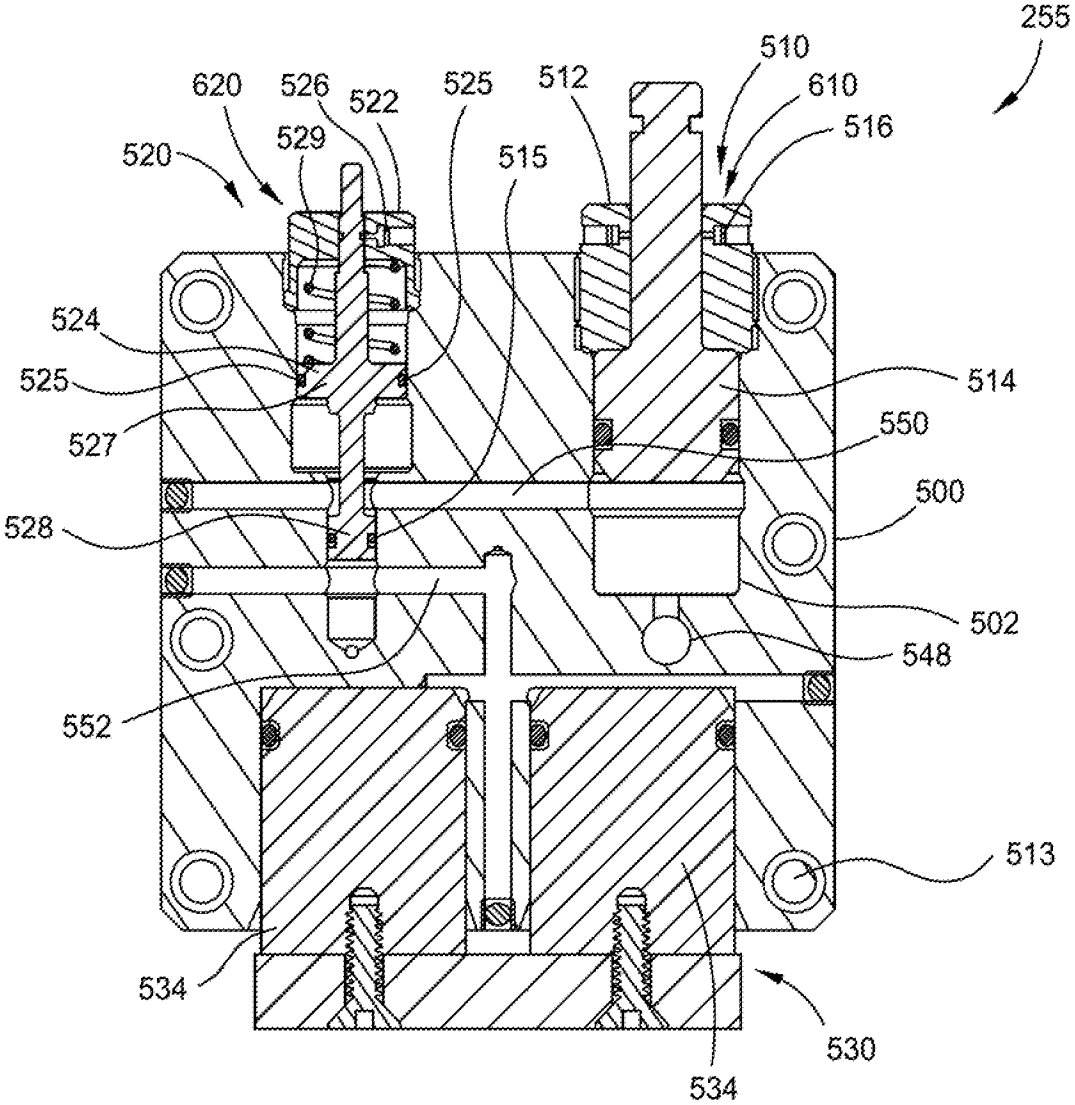

The first piston assembly 510 has a housing connection member 512, first piston 514, and at least one shearable member 516. The housing connection member 512 has a bore therethrough to accommodate a portion of the first piston 514. As illustrated in FIG. 4B, the shearable member 516 releasably attaches the first piston 514 to the housing connection member 512 to retain the first piston 514 in the first position. The housing connection member 512 may be threadedly attached to the housing 500, but it may be attached by other suitable means. One or more sealing members 518 are disposed about the circumference of the first piston 514 and form a seal with the bore 502. When the piston first 514 is in the first position, the first piston 514 blocks fluid flow and pressure from being transmitted from the inlet 548 to the fluid communication lines 550 and 552. The first piston 514 is allowed to move to the second position (shown in FIG. 4C) after pressure applied to the first piston 514 from the inlet 548 is sufficient to shear the shearable member 516. When the first piston 514 is in the second position, it may protrude from the housing connection member 512. When the first piston 514 is in the second position, fluid communication between the inlet 548 and the bore 504 is established via communication line 550.

Figure 4D:
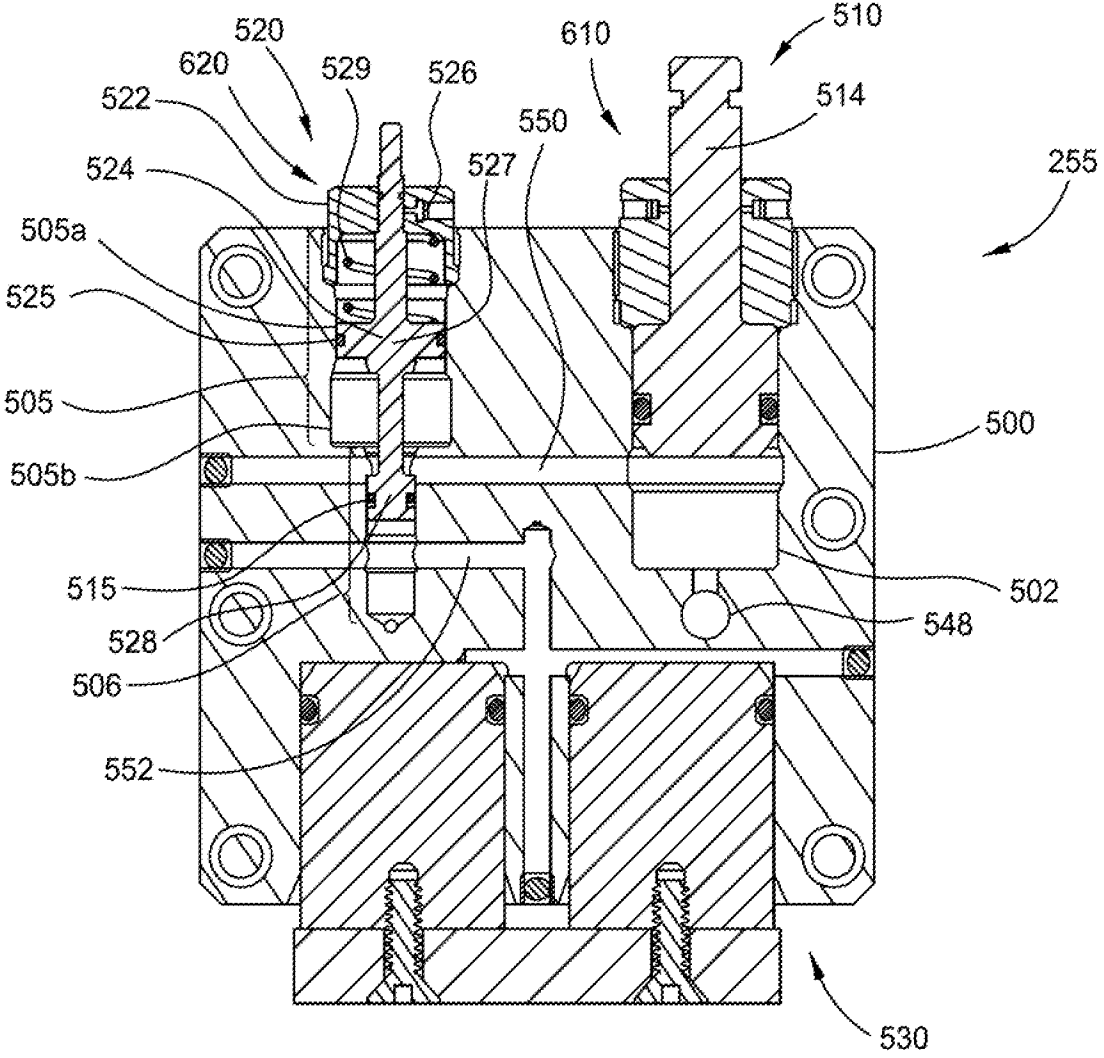
Figure 4E:
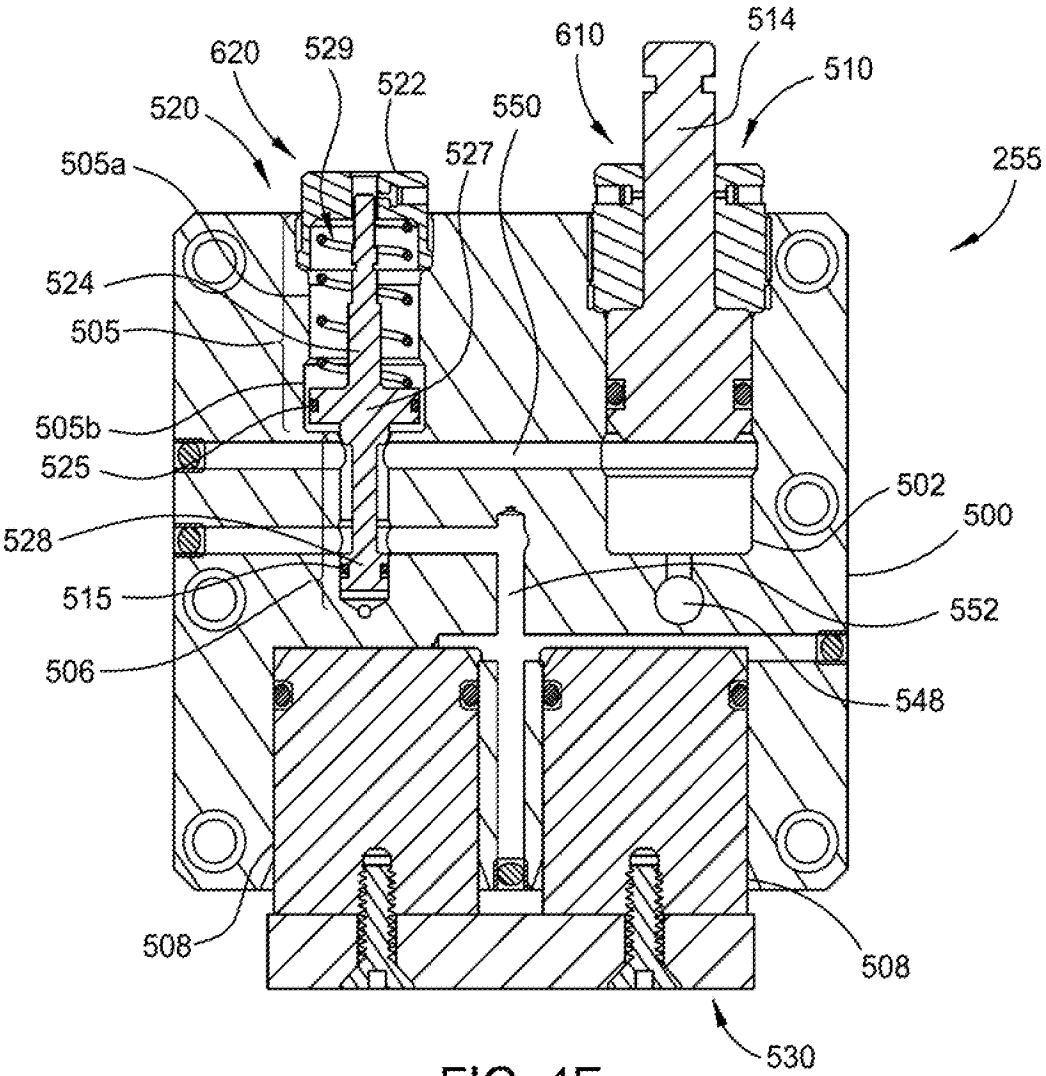

The bore 504 has a first piston bore portion 505 and a second piston bore portion 506. The second piston bore portion 506 has a smaller diameter than the diameter of the first piston bore portion 505. The first piston bore portion 505 has a first diameter portion 505*a* and a second diameter portion 505*b*, wherein the second diameter portion 505*b* has a greater diameter than the first diameter portion 505*a*. The second piston assembly 520 has a housing connection member 522, a second piston 524, and at least one shearable member 526. The housing connection member 522 is threadedly attached to the housing 500, but it may be attached by other suitable means. The housing connection member 522 has a bore accommodating a portion of the second piston 524. The shearable member 526 releasably attaches the second piston 524 to the housing connection member 522 to retain the second piston 524 in the first position, as shown in FIG. 4B. The second piston 524 has a first piston head 527 having a greater piston surface area than a piston surface area of the second piston head 528. The piston heads 527, 528 are spaced apart from each other. One or more sealing members 525 may be disposed about the outer circumference of the first piston head 527 to seal against the first diameter portion 505*a* of bore 504. One or more sealing members 515 may be disposed about the outer circumference of the second piston head 528 to seal against the second piston bore portion 506. The one or more sealing members 515, 525 may be only one sealing member, such as an O-ring. An optional biasing member 529, such as a spring, is disposed between the first piston head 527 and the second housing connection member 522. The first piston head 527 is disposed in the first piston bore portion 505 and the second piston head 528 is disposed in the second piston bore portion 506. As shown in FIG. 4B, the second piston head 528 is disposed in the bore 504 at a location between the fluid communication line 550 and the fluid communication line 552. In this first position, the second piston 524 blocks fluid flow and pressure from being transmitted from the fluid communication line 550 to the fluid communication 552. Sufficient pressure may be applied to the second piston 524 from the inlet 548 to shear the shearable member 526 retaining the second piston 524 in the first position. After shearing, the second piston 524 is allowed to move to the second position (shown in FIG. 4E) to unblock fluid and pressure communication between the fluid communication line 550 and the fluid communication line 552. In the second position, the second piston head 528 is no longer between the fluid communication lines 550, 552. Prior to moving to the second position, the second piston 524 moves to an intermediate position (shown in FIG. 4D) after the shearable member 526 shears. The second piston 524 moves to the intermediate position, and not to the second position, because of the larger piston surface area of the first piston head 527 with respect to the piston surface area of the second piston head 528. In the intermediate position, the second piston 524 may protrude from the housing connection member 522 while the second piston head 528 is still disposed between the fluid communication lines 550, 552 to prevent fluid communication between lines 550 and 552. After flow and/or pressure applied to the latch release mechanism 250 through the inlet 548 drops below a certain level, the biasing member 529 expands to move the second piston 524 to the second position to allow fluid communication between the fluid communication line 550 and fluid communication line 552. When the second piston 524 is in the second position, the first piston head 527 is disposed in the second diameter portion 505*b* of the bore 504. When the first piston head 527 is disposed in the second diameter portion 505*b*, the one or more sealing members 525 disposed about the outer circumference of first piston head 527 no longer seal against the first diameter portion 505*a* of the first piston bore portion 505 of the bore 504. The second piston 524 will not be return to the intermediate position by fluid pressure in the bore 504 after moving to the second position because the first piston head 527 is not in sealing engagement with the second diameter portion 505*b* of the bore 504.

After shearing the shearable members and prior to moving to the second position, fluid pressure fluctuation in the bore 504 may result in the displacement of the second piston 524 by acting on the first piston head 527. The intermediate position of the second piston 524 is any positon that the second piston 524 is in after the shearable members 526 fail and prior to moving to the second position. When in the intermediate position, the one or more sealing members 525 about the outer circumference of the first piston head 527 are maintained in sealing engagement with the first diameter portion 505*a* of the first bore portion 505 of bore 504.

Figure 4F:
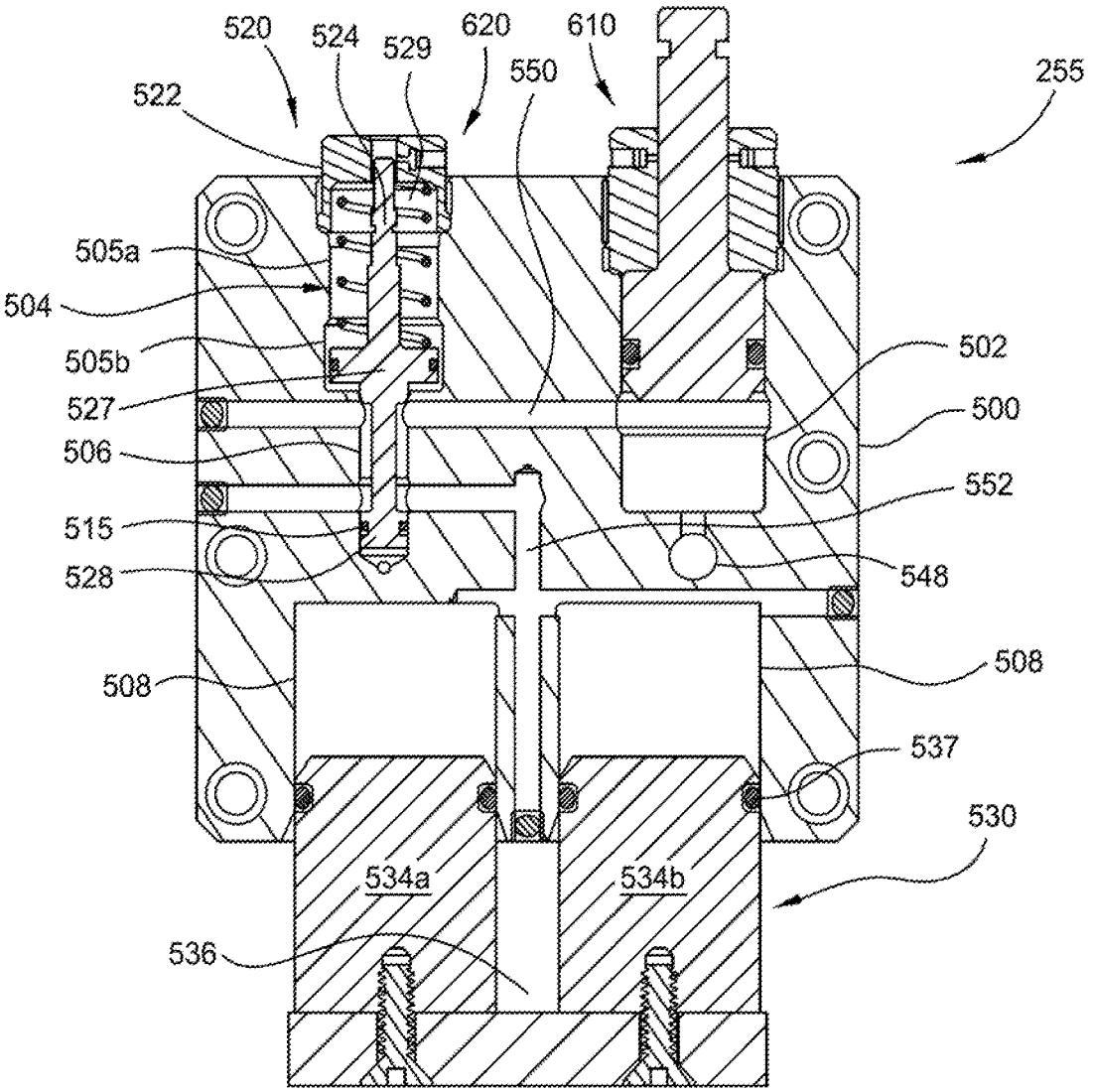

Referring to FIG. 4B, the third piston assembly 530 is at least partially disposed in the bore 508. The bore 508 is in communication with the fluid line 552. When the first piston 514 and the second piston 524 are in their respective second positions, then fluid flow and/or pressure is able to be communicated to the bore 508. The third piston assembly 530 has an actuator piston 534. The actuator piston 534, as illustrated in FIG. 4B, is a tandem piston 534. However, it is contemplated the actuator piston 534 could be one piston or more than two pistons coupled together. The bore 508 is configured to receive the one or more actuator pistons 534 of the third piston assembly 530. The tandem piston 534 have a back member 535 and a recess 536 (see FIG. 4F) between the two individual pistons 534*a,b* of the tandem piston 534 to accommodate the housing 500 between the two individual pistons 534*a,b*. The back member 535 may be attached to each of the individual pistons 534*a,b* by screws, as shown, or by some other suitable connection member. The back member 535 may be formed integral with the actuator piston 534. Sealing members 537 disposed about the individual pistons 534 *a,b* to seal against the housing 500. The sealing members 537 may be an O-ring disposed about each individual piston 534*a,b*. The latch member 270 is attached to the third piston assembly 530, such as being directly attached to the back member 535 or to actuator piston 534. When the actuator piston 534 moves from the first position (see FIG. 4E) to the second position (see FIG. 4F), then the latch member 270 is able to move relative to the housing 500, whipstock 200, and latch portion 430 of the locking member 420. As a result of the actuator piston 534 moving from the first position to the second position, the latch 272 disengages from the latch portion 430 (see FIG. 4G) to allow the locking member 420 of the lock mechanism 400 to move to the retracted position (see FIG. 3B), thus releasing the whipstock 200 from the milling tool 300.

In an alternative embodiment, the fluid communication line 550 has a junction with the first piston bore portion 505 of the second piston bore 504 instead of a junction with the second piston bore portion 506 of the bore 504. The second piston head 528 of the second piston 524 is disposed between the respective junctions of the fluid communication lines 550, 552 with the respective portions 505, 506 of the bore 504 in the first and intermediate position. When the second piston 524 is in the second position, then fluid communication between the fluid communication lines 550, 552 is established. The shearable members 516, 526, may be shear screws or any another suitable type of frangible member, such as shear rings. The shear strength of the shearable member 526 may be selected to be greater than the shear strength of shearable member 516. In one embodiment, this difference in shear strength may be selected such that the pressure in fluid communication line 230 required to shear shearable member 526 is greater than the pressure in the fluid communication line 230 required to shear shearable member 516. Thus, an operator can delay freeing the second piston 524 from the first position for a desired period of time after freeing first piston 514 from the first position. In another embodiment, the shear strength of shearable member 526 can be less than or equal to the shear strength of shearable member 516 such that the shearable member 526 shears after fluid communication from the inlet 548 to the bore 504 is no longer blocked by the first piston 514.

In one embodiment, the first switch 610 has a first configuration corresponding to the first position of the first piston 514 and a second configuration corresponding to the second position of the first piston 514. The second switch 620 has a first configuration corresponding to the first position of the second piston 524, an intermediate configuration corresponding to the intermediate position of second piston 524, and a second configuration corresponding to the second position of the second piston 524. Fluid communication from the inlet 548 to the bore 508 is blocked by the first switch 610 and the second switch 620 when both switches 610, 620 are in their respective first configuration. When the second switch 620 is in the intermediate configuration and the first switch 610 is in the second configuration, fluid communication between the inlet 548 and the bore 508 remains blocked. Fluid communication from the inlet 548 to the bore 508 is unblocked when the first and second switches 610, 620 are in their respective second configurations. Once the second switch 620 is in the second configuration, fluid communication between the inlet 548 and the bore 508 is established and the actuator piston 534 of the latch actuator 255 may be moved in response to fluid communication.

In one embodiment, the latch actuator 255 has the second switch 620 but the first switch 610 is omitted. In this embodiment, the bore 502 and first piston assembly 510 is omitted and the fluid communication line 550 extends from the inlet 548 to the bore 504. Fluid communication from the inlet 548 to the bore 508 is blocked by the second switch 620 when the second switch 620 is in the first and intermediate configurations. Fluid communication from the inlet 548 to the bore 508 is unblocked when the second switch 620 is in the second configuration. Once the second switch 620 is in the second configuration, the actuator piston 534 may be moved in response to fluid communication In one embodiment, the first switch 610 of the latch actuator 255 is a rupture disc. The rupture disc is disposed in the fluid communication line 550. In this embodiment, the rupture disc is used instead of the first piston assembly 510. The rupture disc is configured to fails at a predetermined pressure. After the rupture disc fails, fluid communication is established between the inlet 548 and the bore 504. The first switch 610 is in the first configuration prior to the rupture of the rupture disc and in the second configuration after the rupture of the rupture disc. Thus, the rupture disc is ruptured prior to the actuation of the second switch 620. Fluid communication from the inlet 548 to the bore 508 is blocked by the second switch 620 when the second switch 620 is in the first configuration and the intermediate configuration. Fluid communication is unblocked when the second switch 620 is in the second configuration. Once the second switch is in the second configuration, the actuator piston 534 may be moved in response to fluid communication.

The housing 500 may be manufactured by milling a block of material, such as a metal or dense plastic, to form the first piston assembly bore 502, the second piston assembly bore 504, and the third piston assembly bore 508. Threads can be formed in the first piston assembly bore 502 and second piston assembly bore 504 that corresponds to a threaded portion of their respective housing connection members 512, 522. The fluid communication lines 550, 552 may be formed by drilling into the block of material, including drilling into the respective bores 502, 504 to create a desired junction with the fluid communication lines with the bores. After the fluid connection lines 550, 552 are formed, then the holes formed through a side of the housing 500 are plugged with plugs 560 attached to the housing 500. A bore or channel is formed to accommodate the latch member 270. However, it is also contemplated that the housing 500 may be 3-D printed, thereby omitting the need for plugs 560. It is also contemplated that the housing 500 may be integral with the body 220 of the whipstock 200.

An exemplary operation sequence of the latch release mechanism 250 will now be described in more detail. The BHA 150 is deployed in the wellbore 100 to a desired location and the BHA 150 is turned, using a Measurement-While-Drilling (MWD) or Logging-While-Drilling (LWD) unit coupled to or integral with the BHA 150, such that the angle 215 of the concave face 210 relative to the wellbore 100 is oriented in the direction that the side track will be drilled. Once the proper orientation is reached, fluid pressure or flow is communicated through the fluid communication line 230 to the anchoring mechanism 240 to anchor the whipstock 200 to the wellbore. The fluid communication line 230 is also in communication with the latch actuator 255 of the latch release mechanism 250; however, fluid communication from the inlet 548 (shown in FIG. 4H) to the bore 508 is blocked by first piston assembly 510 and the second piston assembly 520. The shearing of the shearable member 516 and 526 may transpire during or after the anchor of the anchor mechanism 240 is set depending on the shear strength of the shearable members 516, 526. After the shearable members 516, 526 fail, fluid communication between the fluid communication line 230 and the third piston assembly 530 remains blocked by the second piston head 528 of the second piston 524 because the fluid communicated into the latch release mechanism 250 via the fluid communication line 230 will cause the second piston 524 to move to the intermediate position instead of the second position due to the greater piston surface area of the first piston head 527 relative to piston surface area of the second piston head 528.

After the anchor mechanism 240 is set, and the shearable members 516, 526 have been sheared to release their respective pistons 514, 524, the operator initiates a test to determine if the BHA 150 is properly anchored to the wellbore. The test may involve increasing the axial load on the BHA 150 from the surface to determine if the BHA 150 moves beyond an allowable tolerance.

If the BHA 150 moves beyond an allowable tolerance, the operator will determine that the anchor mechanism 240 did not properly anchor the BHA 150 to the wellbore 100. If the anchor mechanism 240 did not satisfactorily anchor the BHA to the wellbore 100, then the BHA 150 may be retrieved from the wellbore. A retrieval tool is not necessary to retrieve the whipstock 200 or anchoring mechanism 240 from the wellbore 100 because the releasable attachment of the whipstock 200 to the milling tool 300 will not release during the anchor test. Thus, only one trip is needed to remove the BHA 150 from the wellbore 100 if the anchoring mechanism 240 does not properly anchor the BHA 150. This saves time and costs associated with a retrieval operation as compared to conventional multi-trip retrieval operations.

If the anchoring test determines that the BHA 150 is properly anchored to the wellbore 100, then the operator may proceed with releasing the whipstock 200 from the milling tool 300. The second piston 524 needs to move to the second position before the whipstock 200 can be released from the milling tool 300. For example, the pressure in the fluid communication line 230 is lowered to below the biasing force of the biasing member 529 of the second piston assembly 520. The biasing member 529 is allowed to expand, thereby causing the second piston 524 to move to the second position. In the second position, the second piston 524 no longer blocks fluid communication between the bore 504 and the bore 508. Thus, fluid communication is established between the fluid communication line 230 and the bore 508.

When the operator is ready to release the whipstock 200 from the milling tool 300, the pressure and or fluid flow is applied through fluid communication line 230 to move the actuator piston 534 from the first position to the second position. If the operator had stopped fluid flow in the line fluid communication 230, then pumping is reestablished to actuate the actuator piston 534 of the third piston assembly 530.

Figure 4G:
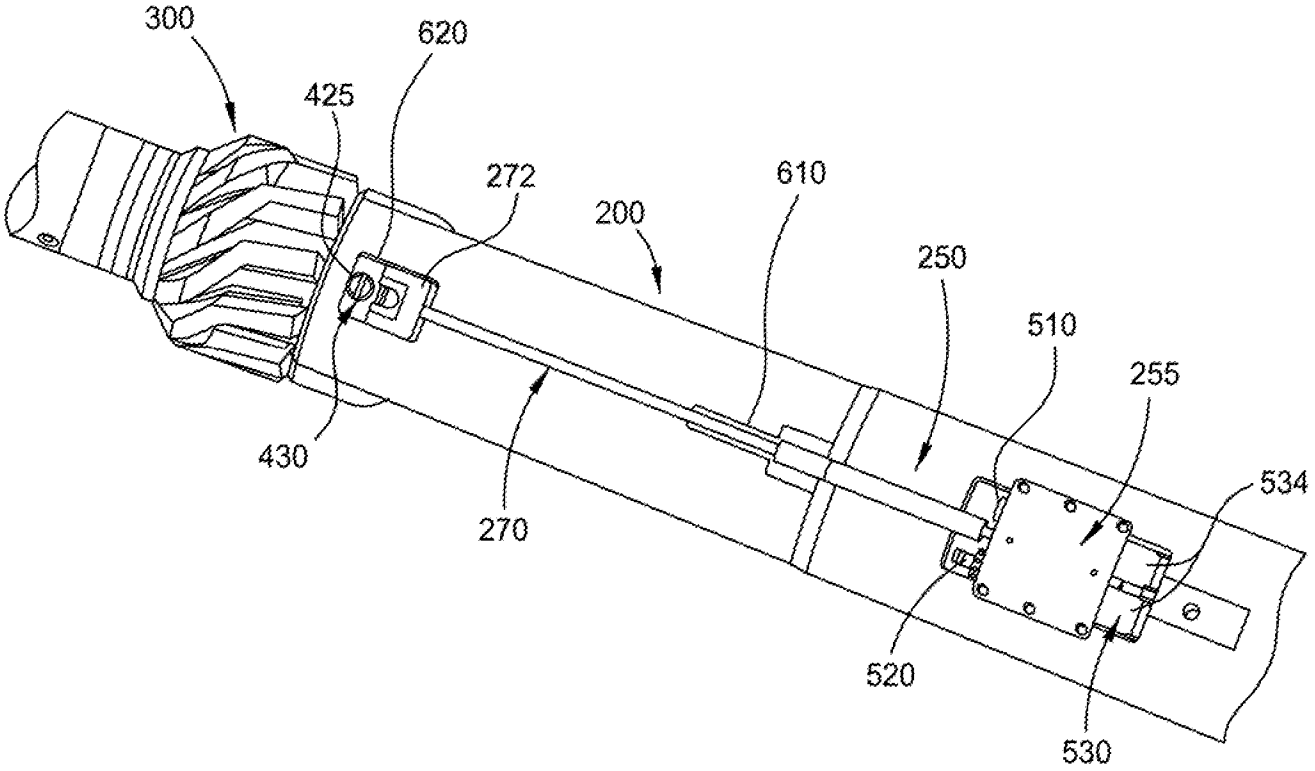

The movement of the actuator piston 534 moves the latch 272 of the latch member 270 away from the latch portion 430 of the locking member 420. Once the latch 272 fully disengages with the latch portion 430 as shown in FIG. 4G, then the locking member 420 is moved from the extended position (FIG. 3A) to the retracted position (FIG. 3B), thereby releasing to whipstock 200 from the milling tool 300.

After the whipstock 200 is released, the milling tool 300 may begin a milling operation to create a side track of wellbore 100. The collar 280 will be completely or partially milled away at the beginning of the operation. The milling tool 300 is moved along the whipstock 200 to form at least a portion of the side track. In some embodiments, a portion of the whipstock 200 and the latch release mechanism 250 will be milled away by the milling tool 300. In some embodiments, the latch actuator 255 will be milled completely away. Thereafter, what remains of the whipstock 200 may be retrieved from the wellbore 100 by a retrieval tool.

Figure 4H:
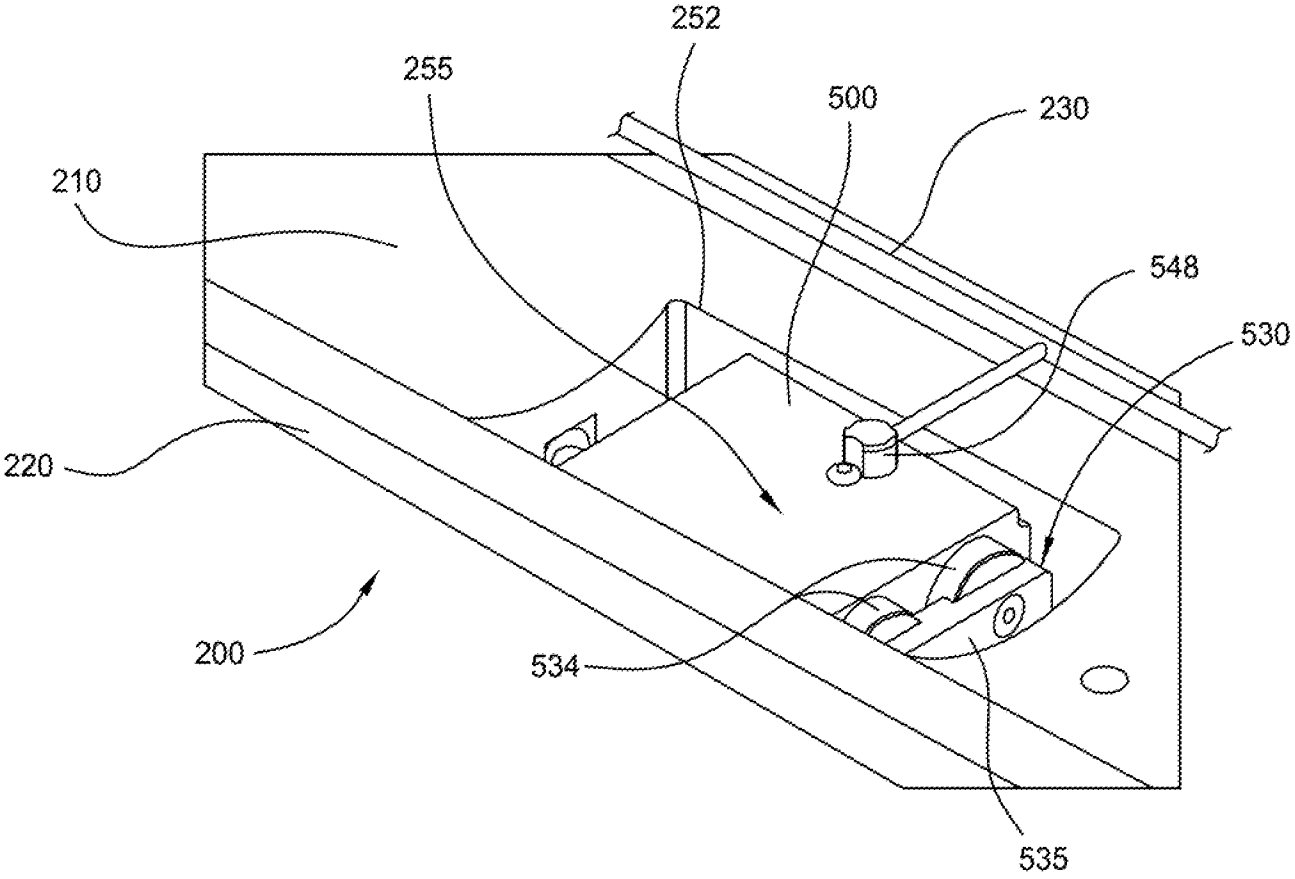

The fluid communication line 230 may be connected to a control line (not shown) that extends to the surface. Alternatively, as shown in FIG. 3A, the fluid communication line is in fluid communication with a bore 350 of the milling tool 300. The bore 350 may have a nozzle 352 disposed therein and be in communication with fluid flow paths 354. Thus, the bore 350 is in fluid communication with the wellbore 100 via the fluid flow paths 354. The nozzle 352 presents a restriction to fluid flow in the bore 350. To generate flow through the nozzle 352, a pressure difference is required, which manifests in a higher pressure in the bore 350 upstream from the nozzle 352 than immediately downstream of the nozzle 352. This higher pressure is communicated through the fluid communication line 230 to both the anchoring mechanism 240 and the latch release mechanism 250. As shown in FIG. 1, the fluid communication line 230 can be disposed outside of the whipstock 200; however, it is contemplated that the fluid communication line 230 may be at least partially disposed within the body 220 of the whipstock 200 as shown in FIG. 4H. It is contemplated that the fluid communication line 230 would be in communication with a bore 350 of the milling tool 300 that does not have a nozzle 352. It is also contemplated that the inlet 548 could not be connected to the fluid communication line 230, and instead would be sensitive to pressure increase and decreases in the wellbore 100 to actuate the piston assemblies 510, 520, 530 of the latch release mechanism 250.

Figure 5A:
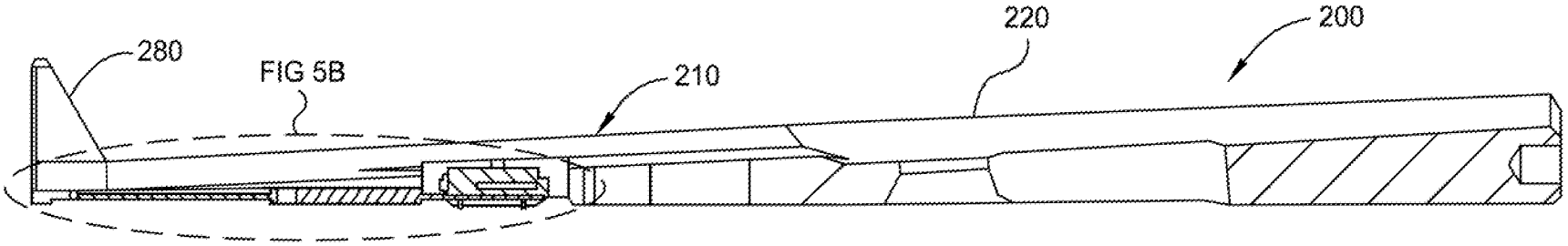
FIGS. 5A-5B illustrate a cross-sectional view of an exemplary whipstock having the latch release mechanism.
Figure 5B:
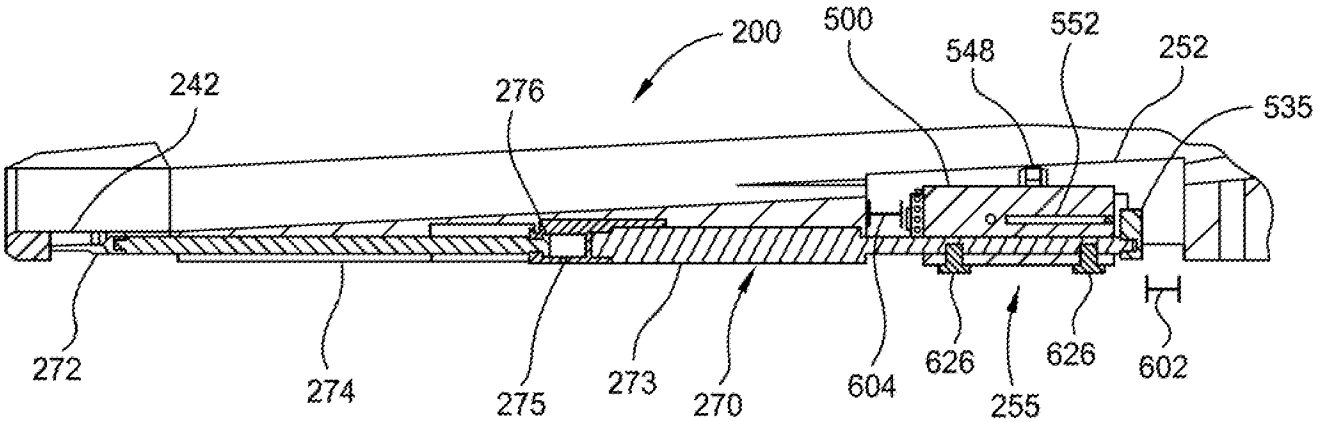

FIG. 5A illustrates a cross section of whipstock 200 with the latch actuator 255 of the latch release mechanism 250 disposed in the aperture 252. FIG. 5B is an expanded view of the region circled in FIG. 5A. A portion of the fluid communication line 552 is shown. The latch member 270 may also be secured to the housing 500 by at least one shearable member 626. The shearable members 626 are configured to retain the latch member 270 in engagement with the latch portion 430 of the locking member 420 during run in of the BHA 150 in the event an obstruction in the wellbore contacts a portion of the latch member 270. The shearable members 626 are sheared, thus releasing the latch member 270 from the housing 500, by the application of sufficient pressure to the actuator piston 534 after fluid communication is established between the inlet 548 and the third piston assembly 530. The latch member 270 and the actuator piston 534 is allowed to move once the shearable members 626 are sheared. Thus, the shearable members 626 retain the latch member 270 in a deployment position and retain the actuator piston 534 in the first position prior to being sheared.

A gap 602 exists between the back member 535 of the third piston assembly 530 and a wall of the aperture 252 in the body 220 of the whipstock 200. The gap 602 is sized to allow for the extension of the actuator piston 534 from the first position to the second position. In an alternative embodiment, the gap 602 may be sized such that, just after the actuator piston 534 reaches the second position and thus allows the latch member 270 to disengage with the latch portion 430 of the locking member 420, the back member 535 contacts the wall of the aperture 252 to prevent further extension of the actuator piston 534 as shown in FIG. 4G. Thus, the extension of the actuator piston 534 is physically restrained by the wall of the aperture 252 and not by the engagement of a portion of the actuator piston 534 with the housing 500. However, it is contemplated that a portion of the actuator piston 534 may limit the extension of the actuator piston 534.

A gap 604, as shown in FIG. 5B, exists between the wall of the aperture 252 and the first piston assembly 510 and the second piston assembly 520. The gap 604 is configured to accommodate the extension of pistons 514 or 524. The gap 604 may be omitted if the pistons 514 or 524 do not extend beyond their respective housing connection members 512, 522.

The actuator piston 534 and latch member 270 of the latch release mechanism 250, shown in FIGS. 5A and 5B, will move in the downhole direction when the actuator piston 534 moves from the first position to the second position. However, it is contemplated that the latch release mechanism 250 can be inverted such that the extension of the actuator piston 534 and latch member 270 will move in the uphole direction when the actuator piston 534 moves from the first position to the second position. The latch 272 of the latch member 270 would be configured to disengage from the latch portion 430 of the locking member 420 when moved uphole by the actuator piston 534.

As shown in FIGS. 5A and 5B, the aperture 252 is formed fully through the body 220 of the whipstock 200. As shown in FIG. 4H, the concave face 210 is partially defined by the aperture 252. However, it is contemplated that the aperture 252 is only formed partially through the body 220 such that a concave face 210 will not be defined, in part, by the aperture 252.

The latch member 270 may be adjustable in length. An embodiment of the adjustable latch member is illustrated in FIGS. 5A and 5B. The latch member 270 may be formed from a first latch member 273 coupled to a second latch member 274 via a connection member 275. The latch 272 of the latch member 270 may be attached to the second latch member 274 and the first latch member 273 may be attached to the third piston assembly 530. The connection member 275 may be adjusted to change the length of the latch member 270. For example, the connection member 275 is threadedly connected to at least one of the first and second latch members 273, 274. Rotation of the connection member 275 may axially move the connection member 275 relative to at least one of the first and second latch members 273, 274. During assembly, the latch member 270 may be extended from a retracted position to an extended position so the latch 272 engages the latch portion 430 of the locking member 420. The abutment of abutment member 276 of the second latch member 274 with an inner surface of the connection member 275 facilitates the translation of the second latch member 274 when the first latch member 273 is translated by the third piston assembly 530.

As shown in FIG. 5B, the latch member 270 is attached to the back member 535 and partially disposed within the wall of the body 220 of the whipstock 200. The latch member 270 may be disposed within a bore formed within the whipstock 200 or a channel 610 formed on the surface of the whipstock 200 as shown in FIG. 4G. A latch channel 620 may be formed in the whipstock 200 to accommodate the movement of the latch 272. The latch member 270 may also be disposed outside of the whipstock 200.

Figure 6A:
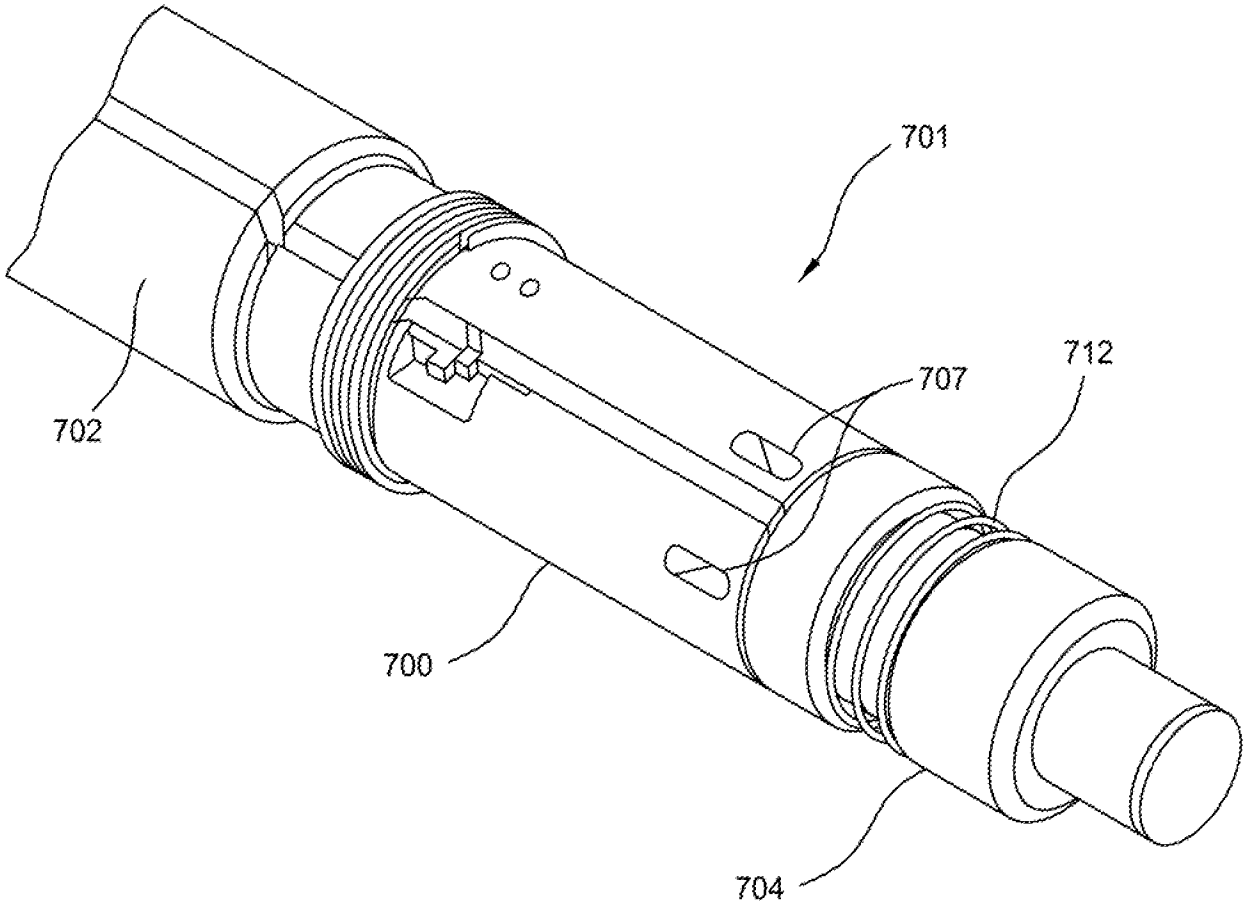
FIGS. 6A-6D illustrate an exemplary configuration of a connection mechanism of a latch release mechanism.
Figure 6B:
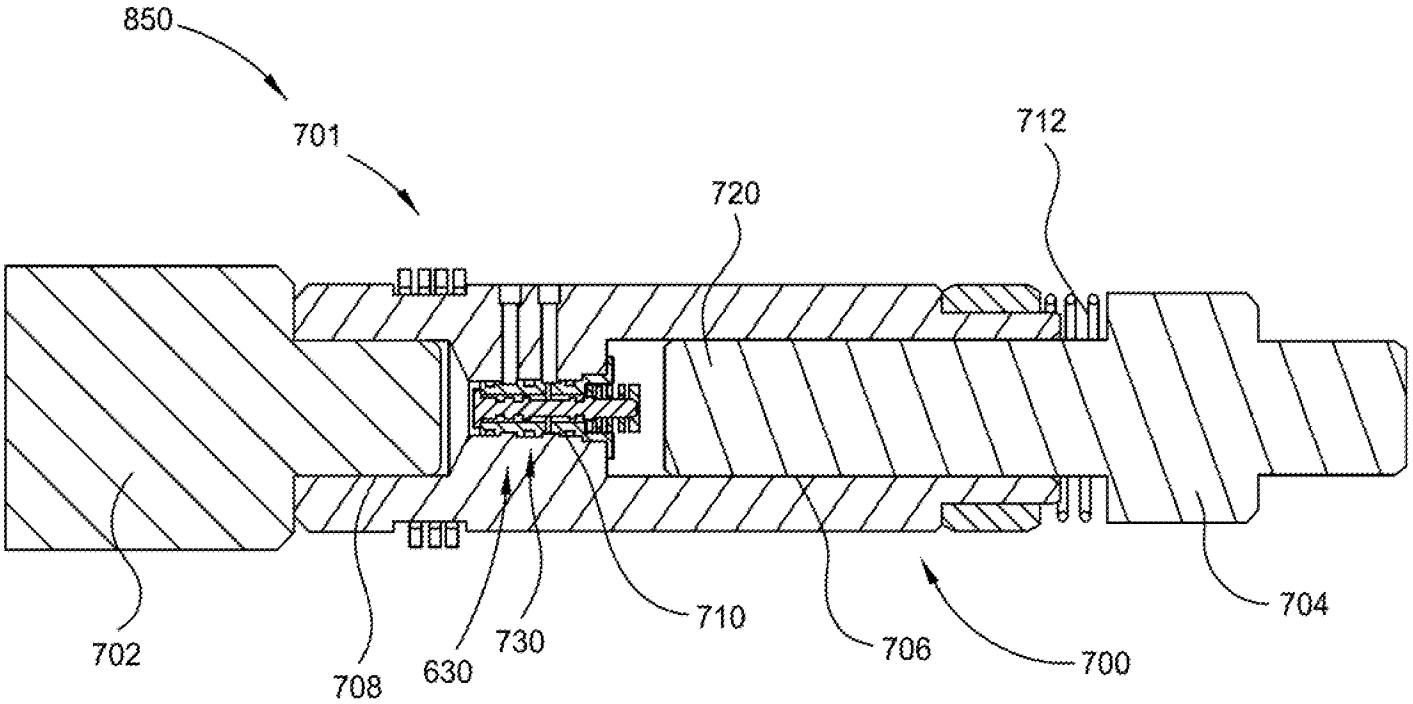

FIGS. 6A-9B illustrate an alternative embodiment a latch release mechanism 850 releasably connecting a whipstock 702 to a downhole tool 300, such as a milling tool. The latch release mechanism 850, whipstock 702, anchor 704, and downhole tool 300 may be part of a BHA. The latch release mechanism 850 includes a connection mechanism 701. As shown in FIGS. 6A-6B, the connection mechanism 701 includes a tubular sub 700 disposed between a whipstock 702 and an anchor 704. The tubular sub 700 has a first bore portion 706, a second bore portion, 708, and a third bore portion 710 that links the first and second bore portions 706, 708. As shown in FIG. 6B, the whipstock 702 is threadedly attached to the second bore portion 708, and the anchor 704 has a mandrel 720 at least partially disposed within the first bore portion 706. A biasing member 712 may be disposed about the mandrel 720 and between adjacent faces of the tubular sub 700 and the anchor 704.

Figure 6C:
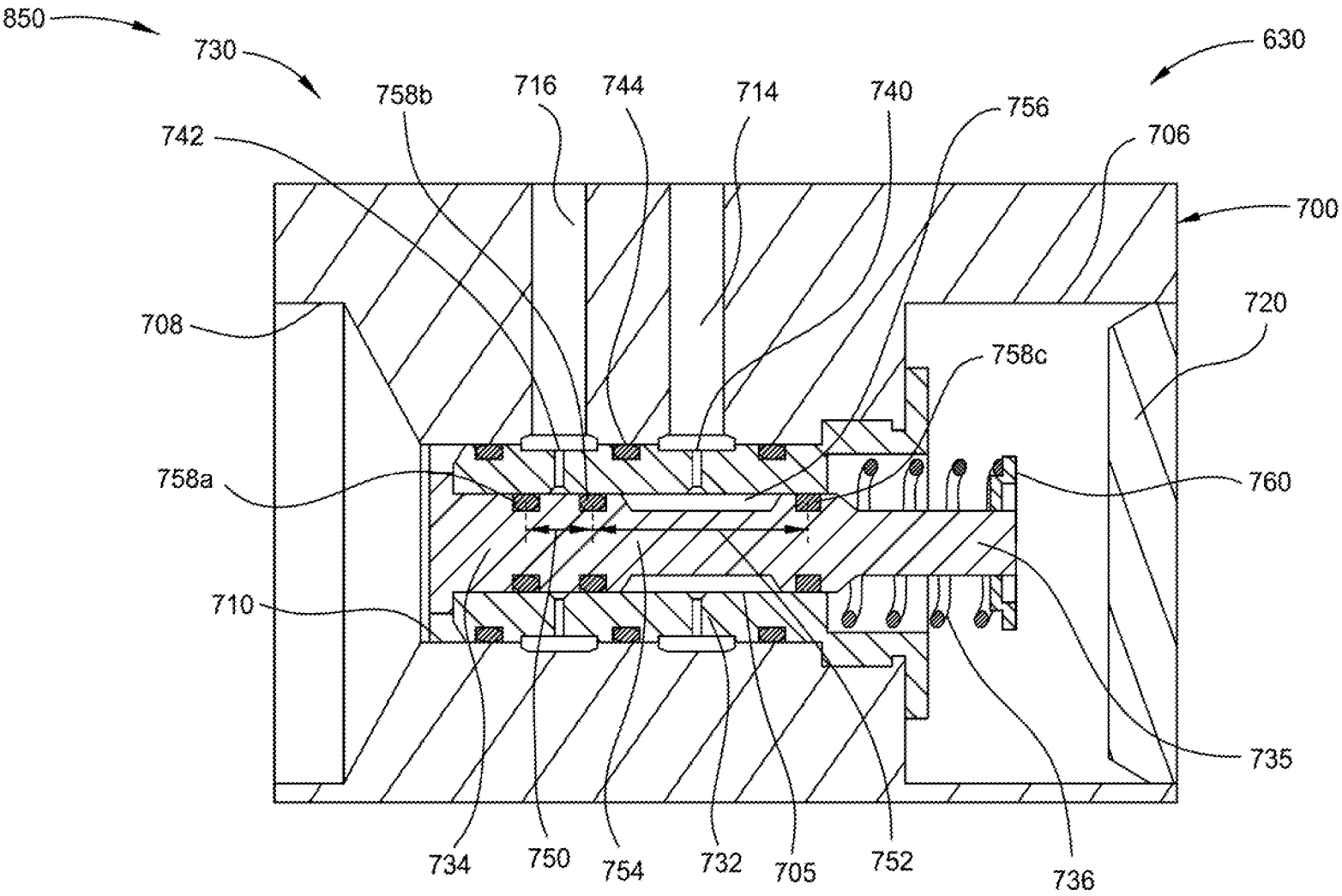
Figure 6D:
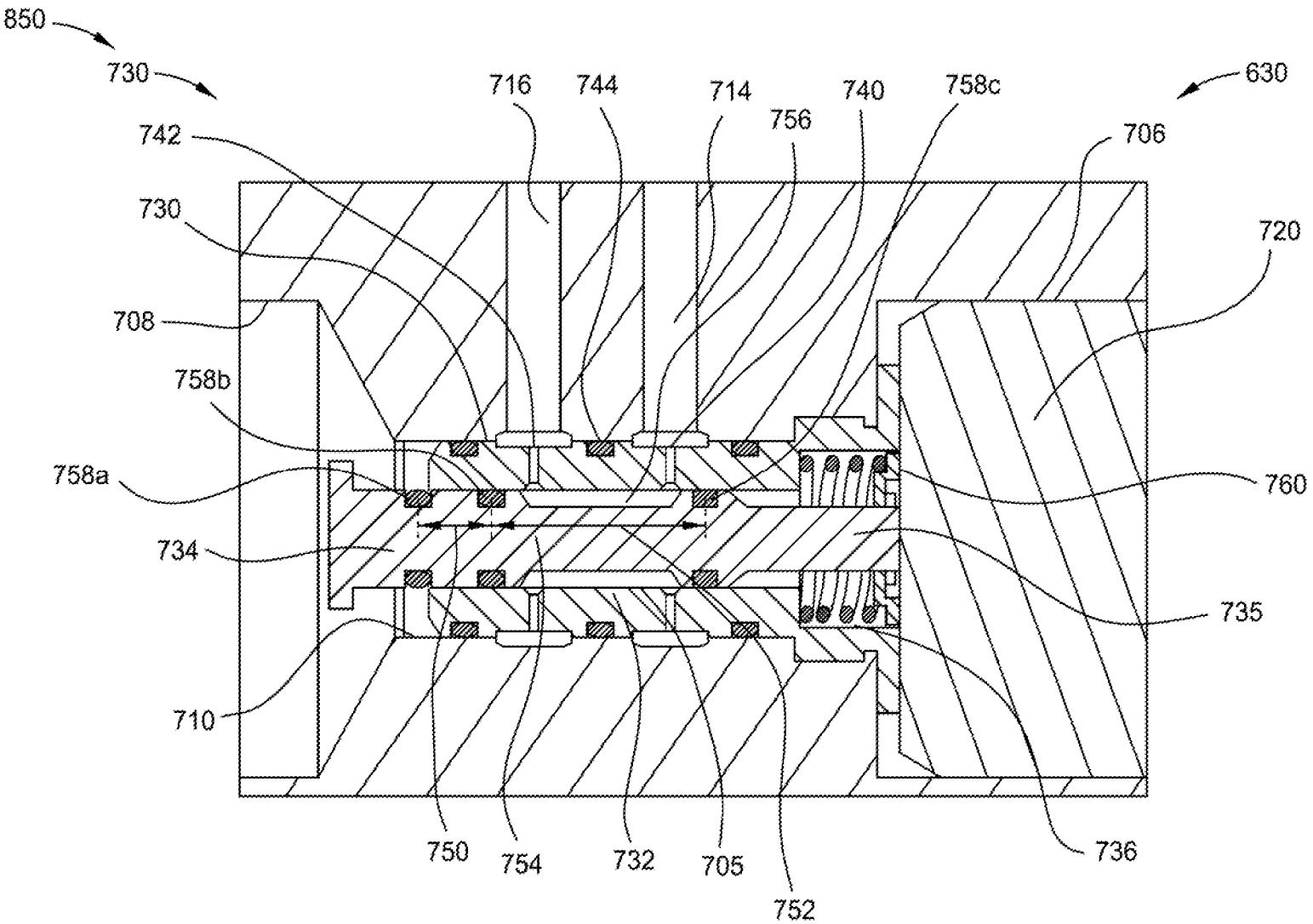

As shown in FIG. 6C, the connection mechanism 701 has a switch 630. The switch 630 is a valve assembly 730 having a first valve member 732 and a second valve member 734 may be at least partially disposed in the third bore 710. The first valve member 732 may be threadedly attached to the tubular sub 700 or attached by other conventional mechanism. In this embodiment, the first valve member 732 is a tubular sleeve having a bore 705, and the second valve member 734 is a cylindrical rod. The second valve member 734 is disposed within the bore 705 of the first valve member 732 and movable from a first position (FIG. 6C) to a second position (FIG. 6D).

The tubular sub 700 may have an inlet port 714 and an outlet port 716. The inlet port is in fluid communication with an inlet port 740 of the first valve member 732. The outlet port 716 is in fluid communication with an outlet port 742 of the first valve member 732. Sealing members 744 prevent unintended fluid communication between the inlet port 714 and outlet port 716 about the outer circumference of the first valve member 732.

The second valve member 734 has rod body 735, a first sealing region 750 defined between sealing member 758*a* and sealing member 758*b*, and a second sealing region 752 defined between sealing member 758*b* and sealing member 758*c*. The sealing members 758*a,b,c* are disposed about the outer diameter of the rod body 735 to seal against the first valve member 732. The rod body 735 of the second valve member 734 has a spacer portion 754 disposed between the sealing members 758*b*, 758*c*. The spacer portion 754 has an outer diameter that is smaller than the outer diameter of the rod body 735 where seals 758*a,b,c* are disposed. An annular chamber 756 is formed between the outer surface of the spacer portion 754 and the first valve member 732, the annular chamber 756 being further disposed between the sealing members 758*b*, 758*c*. A biasing member 736, such as a spring, is disposed between a first end 760 of the second valve member 734 and a shoulder of the first valve member 732. A second end of the second valve member 734 has an outer diameter that is larger than the bore 705 of the first valve member 732. In one embodiment, the first end 760 is a cap that is attached to the rod body 735 after it is inserted into the first valve member 732 and the biasing member 736 is disposed around the rod body 735.

When the second valve member 734 is in the first position, a portion of the second valve member 734 protrudes into the first bore portion 706 of the tubular sub 700. Fluid communication between the inlet port 714 and the outlet port 716, and fluid communication between inlet port 740 and outlet port 742, are blocked by the second valve member 734 when in the first position. As shown in FIG. 6C, the second valve member 734 is positioned such that the outlet port 742 is between two sealing members 758*a,b* defining the first sealing region 750.

When the second valve member is moved to the second position, as shown in FIG. 6D, fluid communication is established between the inlet port 714 and the outlet port 716 because the first sealing region 750 no longer blocks the outlet port 742 of the first valve member 732. In this embodiment, the second valve member 734 has moved left relative to the first valve member 732. In particular, the sealing member 758*b* has moved to the left of the outlet port 742 while the sealing member 758*c* remained to the right of the inlet port 740. In this respect, the inlet port 740 is allowed to communicate with the outlet port 742 via the annular chamber 756 between the sealing members 758*b, c*.

The second valve member 734 is shifted from the first position to the second position by the movement of the mandrel 720 in the first bore 706. The contact of the mandrel 720 with the second valve member 734 is not by itself sufficient to move the second valve member 734 from the first position to the second position. A force is applied by the mandrel 720 that exceeds the biasing force of the biasing member 736 to move the second valve member 734. In this respect, the biasing member 736 prevents unintended movement of the second valve member 734.

In one embodiment, one or more optional shearable members (not shown) may attach the anchor 704 to the tubular sub 700. The shearable members may be sheared upon the application of an axial force from the surface after the anchor 704 has been activated to engage the wellbore 100. The shearable members will fail in response to an axial force that exceeds the shear strength of the shearable members. Once the shearable members fail, the mandrel 720 is free to axially movable relative to the tubular sub 700. The biasing member 712 prevents premature engagement of the mandrel 720 with the second valve member 734 after the mandrel 720 is released.

If an anchor test determines that the anchor 704 failed to properly set against the wellbore 100, then the whipstock 702, anchor 704, and tubular sub 700 can be removed from the wellbore 100. If the anchor test determines that the anchor 704 failed to properly set against the wellbore 100, and the anchor 704 has become stuck, then an axial load can be applied to shear the shearable members to allow the retrieval of the whipstock 702 and the tubular sub 700. Thereafter, a retrieval operation may commence to retrieve the stuck anchor 704.

If the anchor test is passed, and after the shearable members are sheared, then the operator can increase axial force such that the mandrel 720 moves the second valve member 734 from the first to the second position.

In an alternative embodiment, the optional shearable members (not shown) are partially disposed in slots 707 formed in first bore portion 706 of the tubular sub. Thus, the mandrel 720 may move within the tubular sub 700 without shearing the shearable members. The biasing member 712 prevents premature engagement of the mandrel 720 with the second valve member 734. If an anchor test determined that the anchor 704 failed to properly set against the wellbore 100, then the whipstock 702, tubular sub 700, and anchor 704 may be withdrawn uphole because the shearable members will engage the end of the slot 707 without being sheared. If the test anchor test is passed, then the operator can increase axial loading to cause the mandrel 720 to displace the second valve member 734 from the first position to the second positon. The shearable members do not have to be sheared to allow the displacement of the second valve member 734.

The inlet port 714 may be fluidly connected with a fluid communication fluid communication line 230 that is in communication with the anchor 704 and the inlet port 714. Thus, the inlet port 714 may experience a pressure and/or fluid flow to set the anchor 704. The second valve member 734 in the first position blocks fluid communication between the inlet port 714 and the outlet port 716 while the anchor is being set. Then, the operator will test the anchor 704 by increasing axial load on the anchor 704. While the anchor test is performed, fluid flow may be prevented to enter the inlet port 714, such as by ceasing all pumping operations. The anchor test may result in the mandrel 720 advancing into contact with the second valve member 734 and the movement of second valve member from the first position to the second position. If the test is not passed, then the whipstock 702, tubular sub 700, and anchor 704 may be retrieved from the wellbore 100. If the test is not passed, then the operator may commence an additional test. If the anchor test did not cause the displacement of the second valve member 734, then axial load can be increased, if necessary, until the second valve member 734 is moved to the second position. If the test is passed, then reestablishing fluid flow and an increase in pressure through the inlet port 714, such as by resuming pumping operations, will then cause fluid flow and/or pressure to be communicated from the inlet port 714 to the outlet port 716. In some instances, reestablishment of the fluid flow may still occur if the operator decides to not retrieve the BHA based on other criteria. The outlet port 716 directs fluid to a latch actuator 855 of the alternative latch release mechanism 850.

Figure 7A:
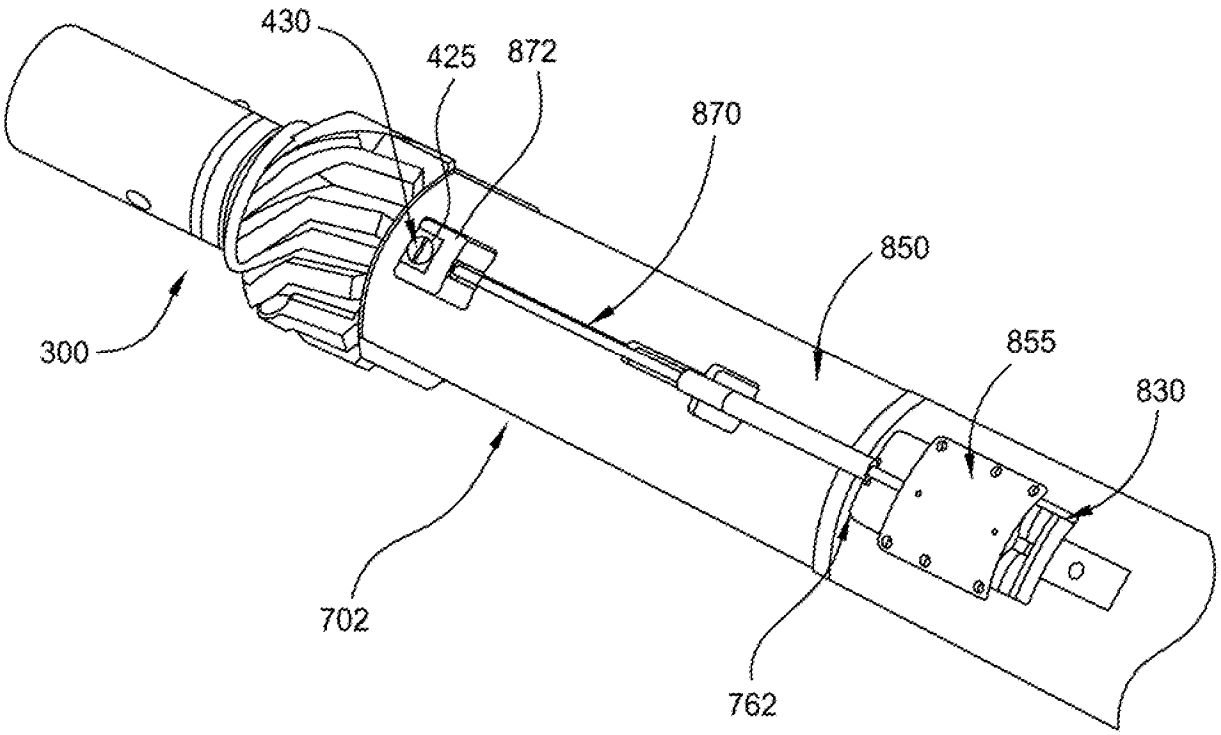
FIGS. 7A-7B illustrate an exemplary configuration of a whipstock releasably attached to a milling tool by the engagement of a latch member of the latch release mechanism with the latch portion of the lock mechanism.
Figure 7B:
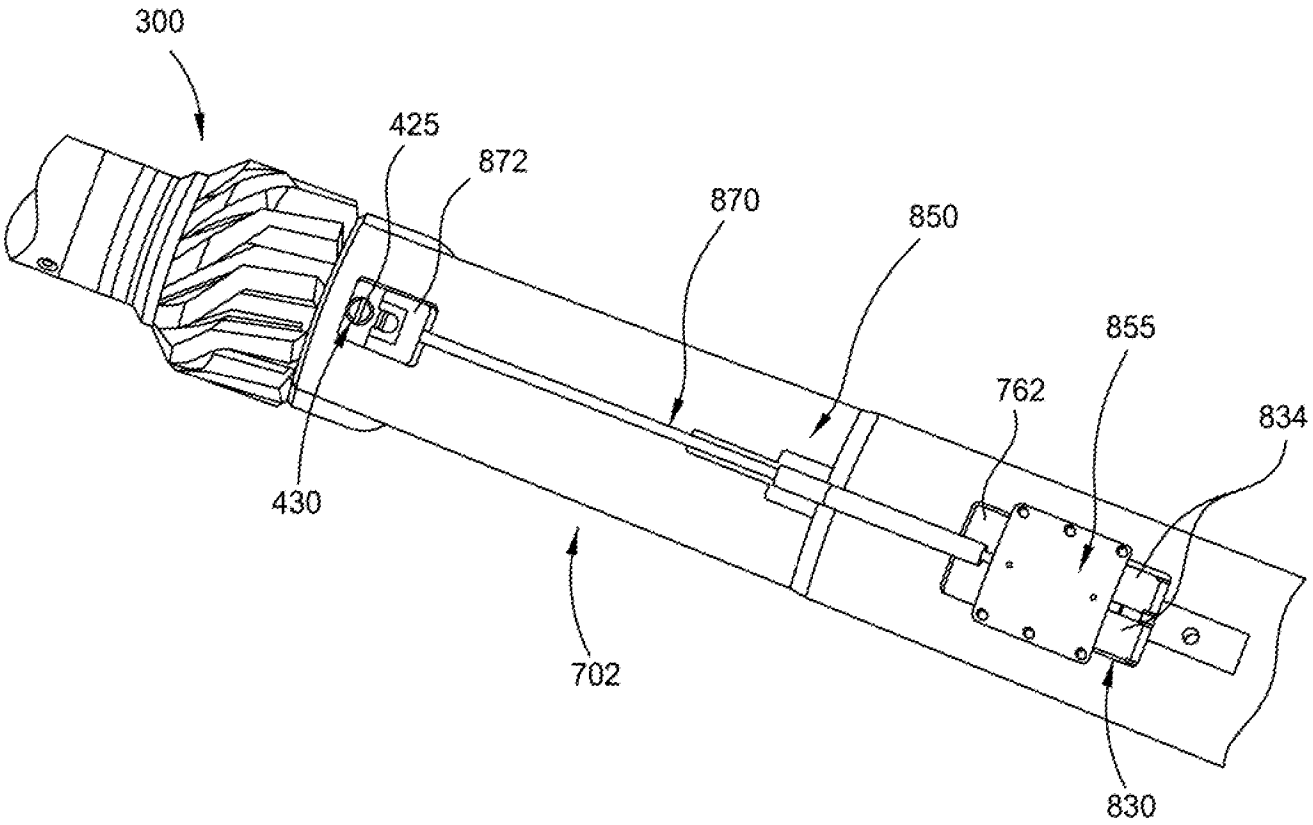

The latch release mechanism 850 has a latch actuator 855, a latch member 870, and the connection mechanism 701. The latch member 870 may have a latch 872 attached at one end. FIG. 7A shows the whipstock 702 attached to the downhole tool 300, such as a milling tool. As shown in FIG. 7A, the latch 872 is in engagement with the latch portion 430 of the lock mechanism 400 of the downhole tool 300. FIG. 7B shows the latch member 870 disengaged from the latch portion 430 after the latch member 870 is moved by the latch actuator 855. The whipstock 702 is released from the downhole tool once the latch member 870 disengages from the latch portion 430 of the lock mechanism 400.

As shown in FIG. 7A, the latch actuator 855 is disposed in an aperture 762 of the whipstock 702, which is similar to aperture 252. The latch actuator 855 may be attached to the whipstock 702 such as by a bolts or screws inserted through mounting bores 813 formed in the housing 800 of the latch actuator 855.

Figure 8:
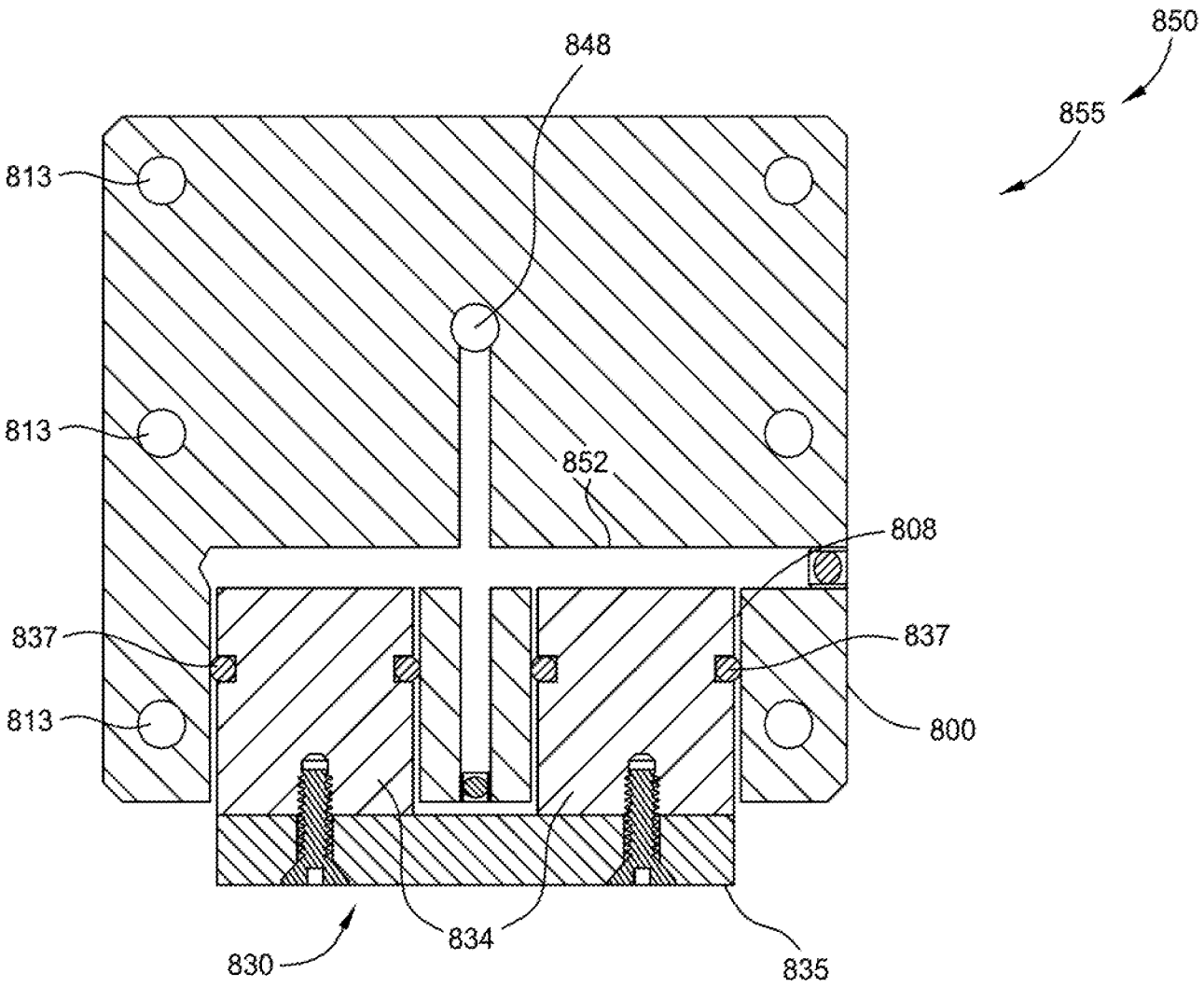
FIG. 8 illustrates a cross-sectional view of an exemplary configuration of the latch actuator of the latch release mechanism.

An embodiment of the latch actuator 855 is illustrated in FIG. 8. The latch actuator 855 has a housing 800, and a piston assembly 830 having at least one actuator piston 834 disposed in a piston assembly bore 808 of the housing 800. An inlet 848 of the housing 800 is in fluid communication with the bore 808 via a fluid communication line 852. The housing 800 may be integral with the downhole tool, such as whipstock 702.

Figure 9A:
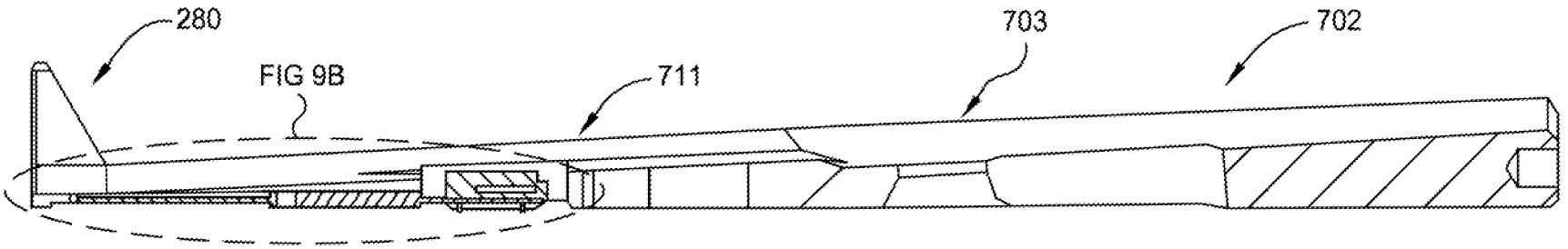
FIGS. 9A-9B illustrate a cross-sectional view of an exemplary whipstock having the latch actuator and latch member of the latch release mechanism.
Figure 9B:
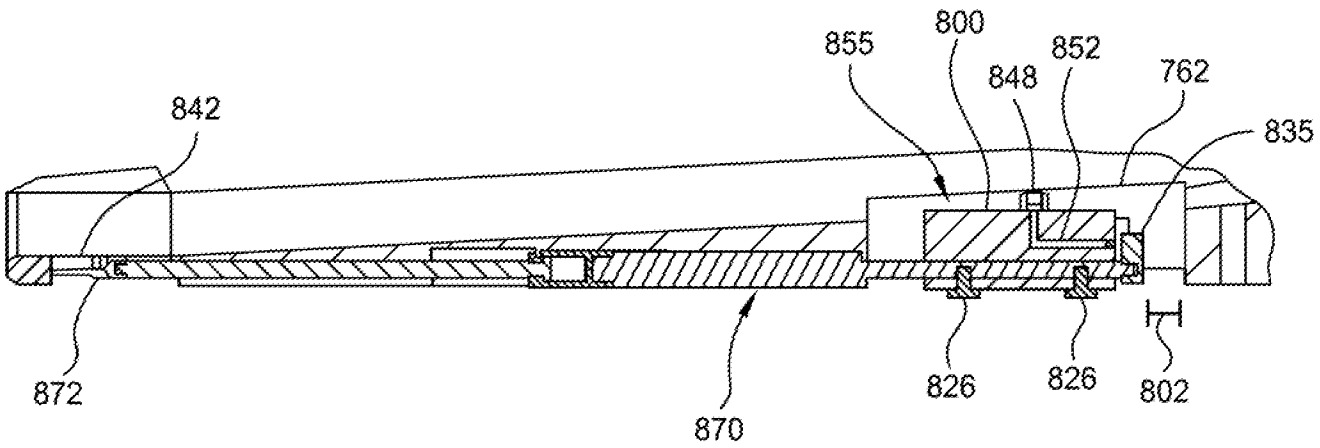

In some embodiments, as shown in FIG. 9A-B, the whipstock 702 may have a collar 280 and an aperture 842, similar to aperture 242, to facilitate axial and torsional load applied to the whipstock 702 and downhole tool 300 while isolating the lock mechanism 400 from torsional and/or axial loading.

The latch member 870, having a latch 872, of the latch release mechanism 850 is connected to the piston assembly 830. The latch member 870 and latch 872 are similar to the latch member 270 having latch 272. The latch member 870 may be partially disposed in a wall of the whipstock 702, a channel formed on an outer surface of the whipstock 702, or disposed outside of the walls of the whipstock 702. The latch 872 engages the latch portion 430 of the locking member 420. Shearable members 826, similar to shearable members 626, initially retain the latch member 870 in a fixed position relative to the housing 800. The shearable members 826 are sheared, thus releasing the latch member 870 from the housing 800, by the application of sufficient pressure to the actuator piston 834 after the second valve member 734 has been moved to the second position. Thus, the shearable members 826 retain the latch member 870 in a deployment position and retain the actuator piston 834 in the first position prior to being sheared. Once the latch 872 has moved out of engagement with the latch portion 430 of the lock mechanism 400, then the locking member 420 may retract allowing the release of the whipstock 702 from the downhole tool 300. The latch member 870 may be partially disposed in housing 800. The latch member 870 is attached to the actuator piston 834 or a back member 835.

Fluid communication directed to the latch actuator 855 of the latch release mechanism 850 enters the housing via inlet 848. The inlet 848 is in fluid communication with piston assembly bore 808 via a fluid communication line 852. The piston assembly 830 may be similar to the third piston assembly 530. As shown in FIG. 8, the actuator piston 834 may be a tandem piston, similar to tandem piston 534, and has a back member 835. However, it is contemplated that actuator piston 834 may be one piston or more than two pistons. The actuator piston 834 may have one or more sealing members 837 disposed about each individual piston of the actuator piston 834 to seal against the piston assembly bore 808. In some embodiments, the one or more sealing members 837 is an O-ring disposed about each individual piston.

Fluid flow and or pressure communicated from the outlet port 716 to the piston assembly bore 808 will displace the actuator piston 834 from a first position to a second position. When the actuator piston 834 moves to the second position, then the latch member 870 moves with respect to the latch portion 430, thereby allowing the locking member 420 to retract. The aperture 762 may be sized sufficiently to accommodate the movement of the actuator piston 834 from the first position to the second position in a similar manner to aperture 252.

As shown in FIGS. 9A-9B, a gap 802 exists between the back member 835 of the piston assembly 830 and a wall of the aperture 762 in the body 703 of the whipstock 702. The whipstock has a concave face 711. The gap 802 is sized to allow for the extension of the actuator piston 834 from the first position to the second position. In an alternative embodiment, the gap 802 may be sized such that, just after the actuator piston 834 reaches the second position and thus allows the latch member 870 to disengage with the latch portion 430 of the locking member 420, the back member 835 contacts the wall of the aperture 762 to prevent further extension of the actuator piston 834 as shown in FIG. 7B. Thus, the extension of the actuator piston 834 is physically restrained by the wall of the aperture 762 and not by the engagement of a portion of the actuator piston 834 with the housing 800. However, it is contemplated that a portion of the actuator piston 834 may limit the extension of the actuator piston 834. It is contemplated that the latch release mechanism 850 maybe be orientated such that the movement of the actuator piston 834 and latch member 870 occur in either the uphole or downhole direction with respect to the housing 800.

The switch 630 is in the first configuration when the second valve member 734 is in the first position. The switch 630 is in the second configuration when the second valve member 734 is in the second position. Thus, the switch 630 blocks fluid communication from the fluid communication line 230 to the inlet 848, and thus the bore 808, when in the first configuration and unblocks fluid communication from the fluid communication line 230 to the inlet 848, and thus the bore 808, when in the second configuration. Once the switch 630 is in the second configuration, the actuator piston 834 may be moved in response to fluid communication.

An exemplary method of using the alternative latch mechanism 850 will be discussed below. The anchor 704 and whipstock 702 connected to the downhole tool 300 by the engagement of the latch member 870 with the lock mechanism 400 is deployed downhole. Once in the desired location and position within the wellbore 100, the anchor 704 is set by communicating fluid flow and or pressure from the fluid communication line 230 to the anchor 704. Fluid communication between the latch actuator 855 and the fluid communication line 230 is blocked during the setting of the anchor 704 by the position of the second valve member 734. A test of the anchor 704 commences by the application of axial load to the anchor 704 and the cessation of pumping operations. The axial load applied during the test causes the mandrel 720 to move into contact with the second valve member 734 resulting in the second valve member 734 moving from the first to the second position. No fluid flow or pressure is communicated through the valve assembly 730 to the latch actuator 855 because no fluid flow or pressure is being supplied downhole from the surface.

If the operator determines that the anchor 704 passes the test, fluid flow and or pressure are supplied downhole. For example, fluid flow from the surface and through the nozzle 352 creates a high pressure zone in the milling tool bore 350 which allows facilitates fluid communication through the fluid communication line 230 to the valve assembly 730 and the latch actuator 855. Because the second valve member 734 has moved from the first to the second position, fluid communication between the inlet port 714 and the outlet port 716 is established. Fluid communication is thus allowed between the fluid communication line 230 and the latch release mechanism 850. The operator then increases pressure until the shearable members 826 shear allowing the latch member 870 and the actuator piston 834 to move. The actuator piston 834 is then displaced from the first position to the second position, causing the latch 872 of the latch member 870 to disengage with the latch portion 430 of the lock mechanism 400 to allow the locking member 420 to retract and thus release the milling tool 300 from the whipstock 702. Then, the detached milling tool 300 may begin a milling operation to create a side track in the wellbore 100. The whipstock 702, tubular sub 700, and anchor 704 can be removed from the wellbore by a retrieval tool.

In some embodiments, the latch release mechanism 250, 850 is configured to attach a first downhole tool to a second downhole tool before being actuated to release the first downhole tool from the second downhole tool. In one embodiment, the first downhole tool is a milling tool 300. In another embodiment, the first downhole tool is a running tool. In another embodiment, the second downhole tool is a packer. In another embodiment, the second downhole tool is an anchor.

In one embodiment, the first valve member 732 and sealing members 744 are omitted. A biasing member 736, such as a spring, is disposed between a first end 760 of the second valve member 734 and a shoulder of the tubular sub 700. Thus, the second valve member 734 is at least partially disposed in the third bore portion 710. The annular chamber 756 is formed between the outer surface of the spacer portion 754 and the inner surface of the tubular sub 700, the annular chamber 756 being further disposed between the sealing members 758*b*, 758*c*. The first sealing region 750 of the second valve member 734 blocks fluid communication between the inlet port 714 and the outlet port 716 when the second valve member is in the first position and fluid communication is unblocked when the second valve member 734 is in the second position.

Figure 10A:
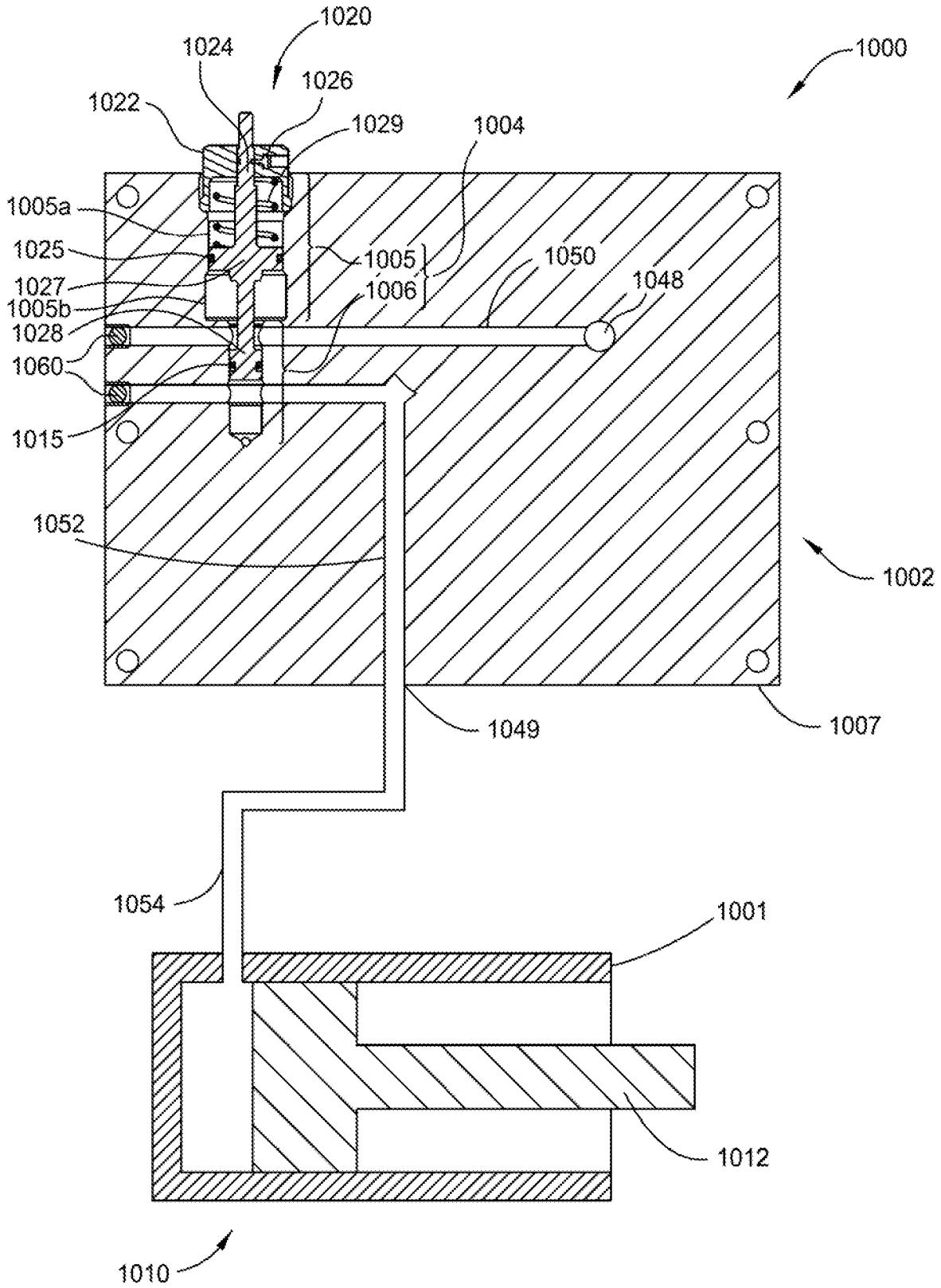
FIGS. 10A-10C illustrate an exemplary configuration of a downhole tool actuator assembly having a switch assembly and an actuator.
Figure 11A:
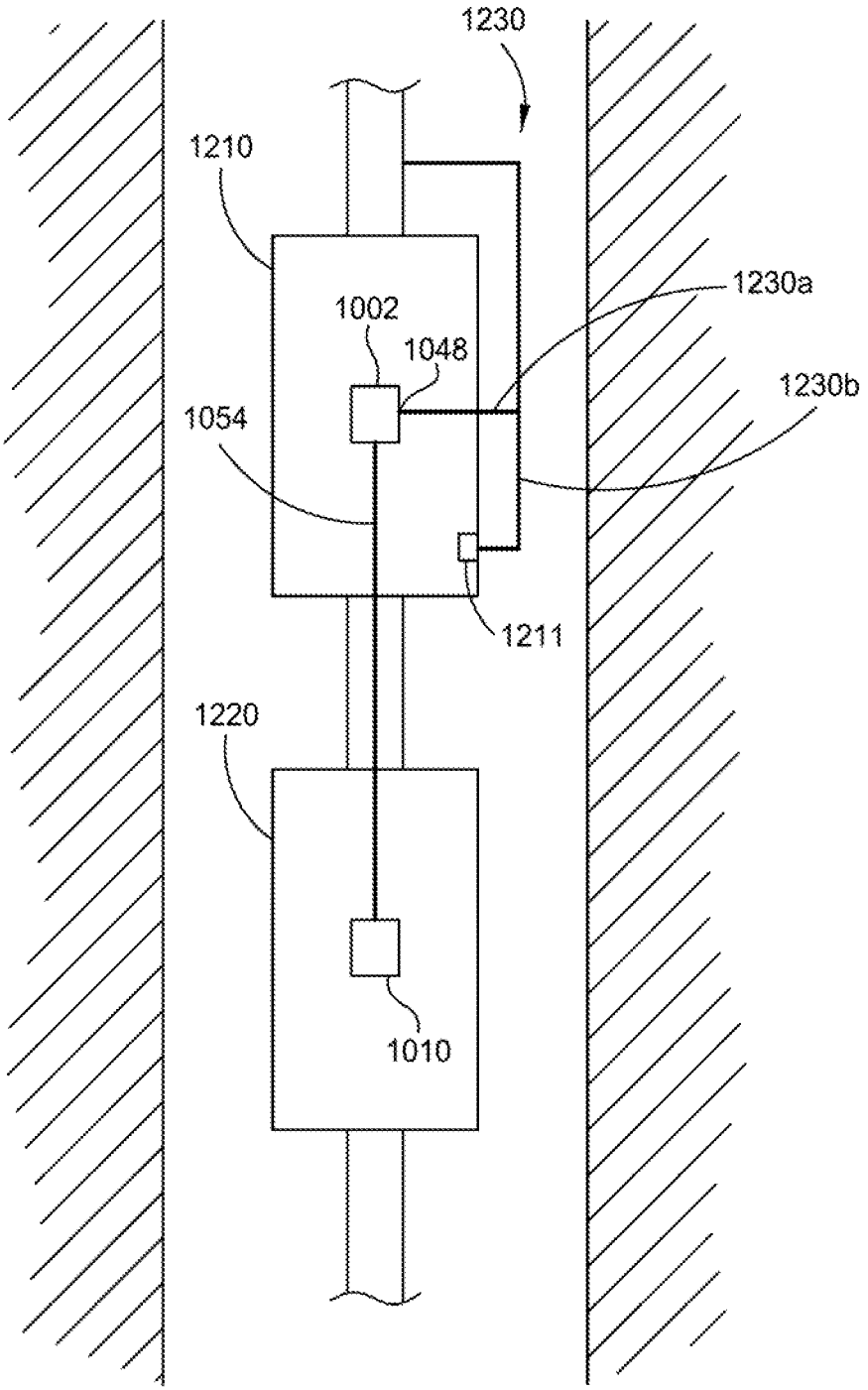
FIG. 11A illustrates the switch assembly of the downhole tool actuator assembly coupled to a first downhole tool and the actuator of the downhole tool actuator assembly coupled to a second downhole tool.

FIG. 10A shows a downhole tool actuator assembly 1000 having a switch assembly 1002 and an actuator 1010. As shown in FIG. 11A, the switch assembly 1002 may be incorporated into or disposed on a first downhole tool 1210, and the actuator 1010 may be incorporated into or disposed on a second downhole tool 1220. The actuator 1010 can activate or operate a downhole tool, such as the second downhole tool 1220. The switch assembly has a housing 1007 and a switch 1020. The switch has a piston 1024 initially retained in a first position (FIG. 10A) by at least one shearable member 1026. The shearable member 1026 may be partially attached to the housing 1004 or to a housing connection member 1022. The piston 1024 is disposed in a bore 1004 of the housing 1007. The bore 1004 is similar to bore 504, in that it has a first bore portion 1005 and a second bore portion 1006. The first bore portion 1005 has a first diameter portion 1005*a* and a second diameter portion 1005*b*, wherein the second diameter portion has a greater diameter than the first diameter portion 1005*a*. Fluid communication line 1050 is in communication with inlet 1048 and the bore 1004. Fluid communication line 1052 is in communication with the bore 1004 and outlet 1049. One end of the fluid communication lines 1050, 1052 may be sealed by plugs 1060 to facilitate manufacturing of the switch assembly 1002. A fluid communication line 1054 is in communication with the outlet 1049 and the actuator 1010. The fluid communication line 1054 has a length to span the distance between the outlet 1049 and the actuator 1010. Thus, the inlet 1048 is in fluid communication with the piston assembly 1010. The actuator 1010 has a housing 1001 and an actuator piston 1012 at least partially disclosed in the housing 1001. The actuator piston 1012 is movable from a first position to a second position in response to fluid communication from the inlet 1048. The actuator 1010 activates or actuates the first downhole tool 1210 when in the actuator piston 1012 is in the second position.

Figure 10B:
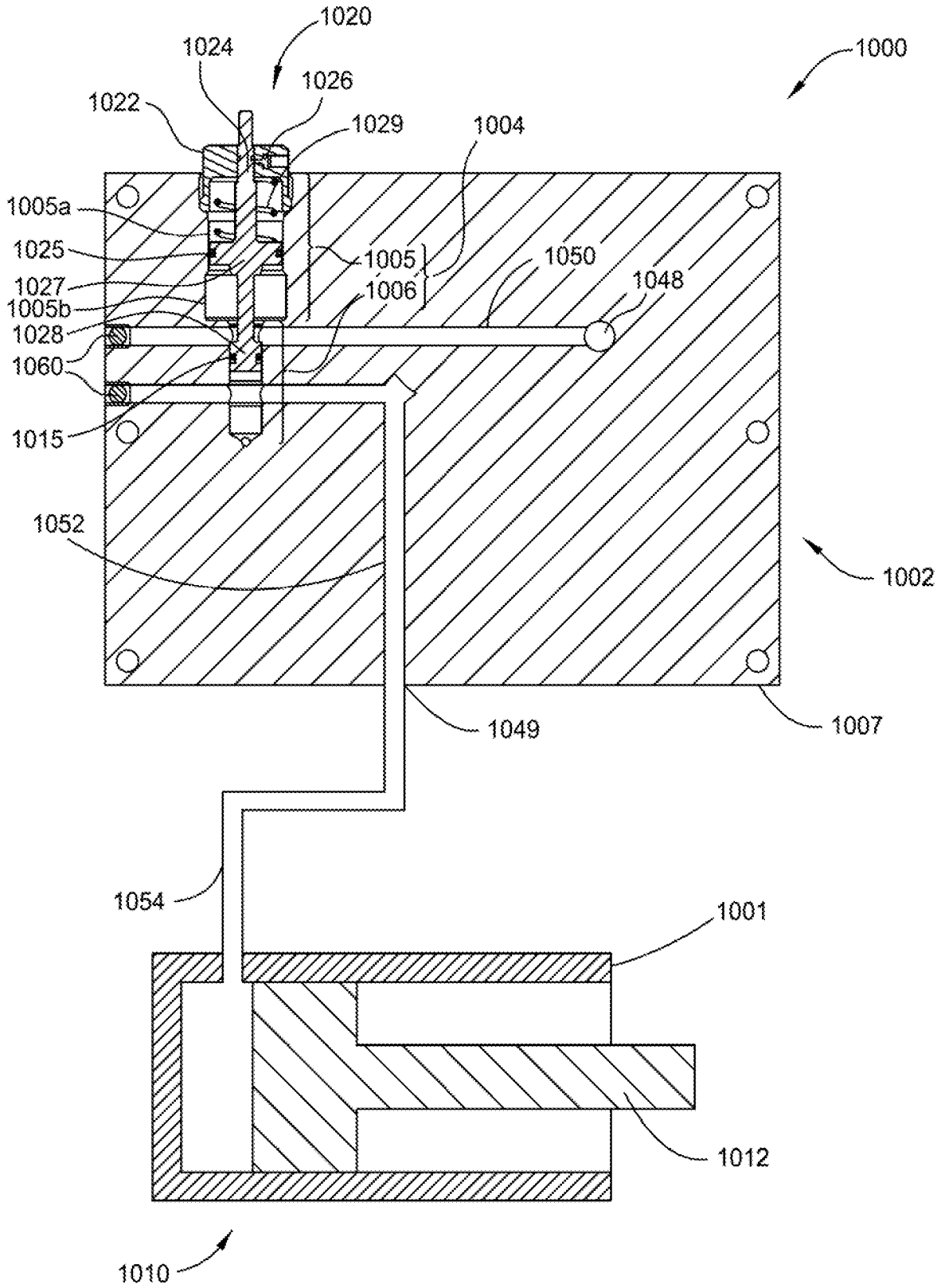
Figure 10C:
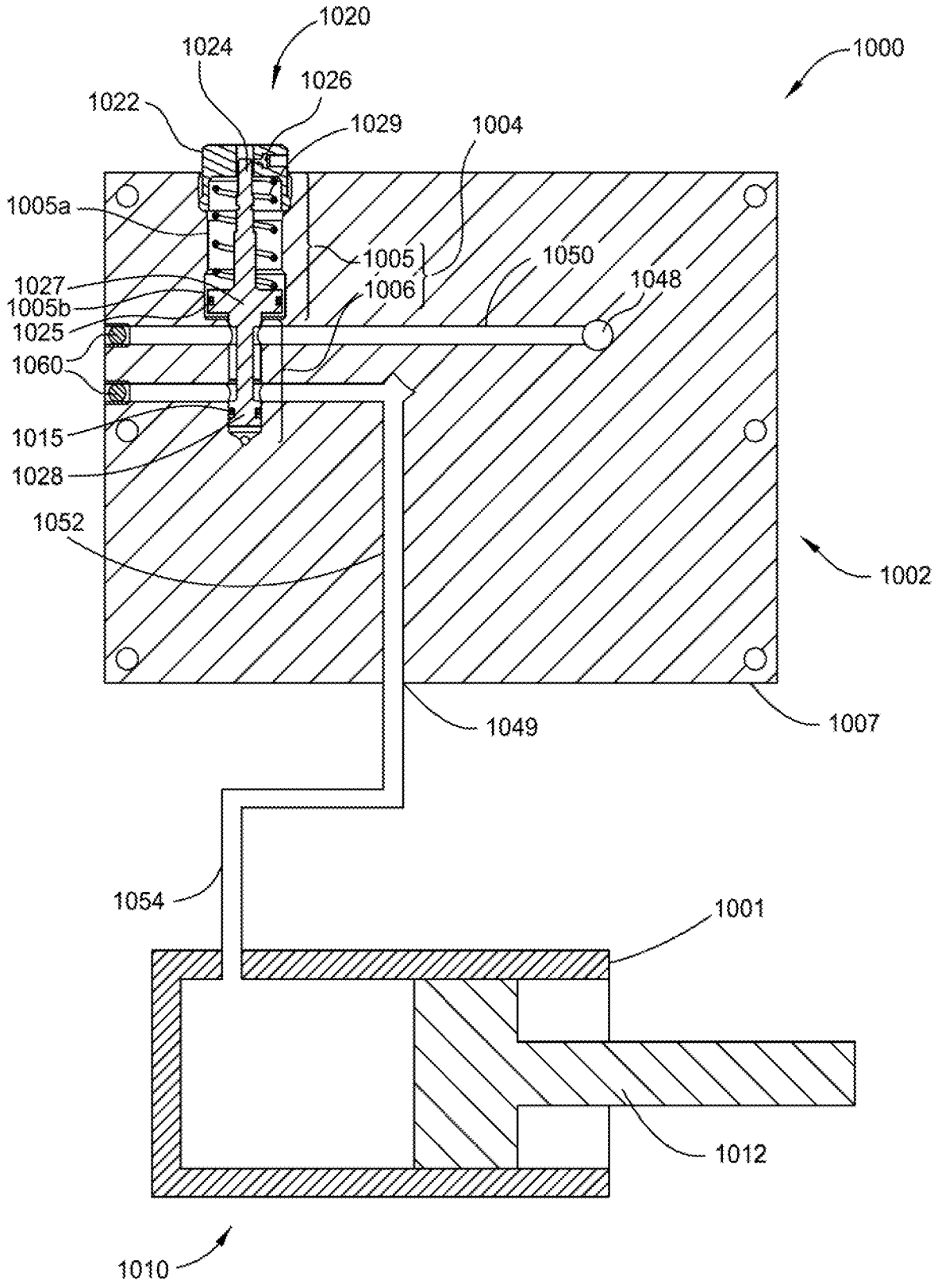

The piston 1024 has a first piston head 1027 having a greater piston surface area than a piston surface area of a second piston head 1028. The first piston head 1027 has one or more sealing members 1025 disposed about the outer circumference of the first piston head 1027 configured to seal against the first diameter portion 1005*a* of the first bore portion 1005 of the bore 1004 when the piston 1024 is in the first position (FIG. 10A) and the intermediate position (FIG. 10B). The second piston head 1028 has one or more sealing members 1015 disposed about the second piston head 1028 and configured to seal against the second bore portion 1006 of the bore 1004. The one or more sealing members 1015, 1025 may be only one sealing member, such as an O-ring. The first piston head 1027 is disposed in the first portion 1005 of the bore 1004. The second piston head 1028 is disposed in the second bore portion 1006. When the piston 1024 is in the first position (FIG. 10A) and intermediate position (FIG. 10B), the second piston head 1028 is disposed between the junctions of the fluid communication lines 1050, 1052 with the bore 1004 and blocks fluid communication between the fluid communication lines 1050, 1052. Since fluid communication is blocked between the fluid communication lines 1050, 1052, fluid communication is also blocked between the inlet 1048 and the outlet 1049. The piston 1024 is allowed to move from the first position when fluid pressure applied to the piston 1024 is sufficient to shear the shearable members 1026. The piston 1024 moves to the intermediate position as shown in FIG. 10B, and not the second position as shown in FIG. 10C, because of the differential in piston head areas of the piston heads 1027, 1028. The piston surface area of the first piston head 1027 is greater than the piston surface area of the second piston head 1028. Once pressure decreases below the biasing force of biasing member 1029, the biasing member 1029 extends moving the piston 1024 to the second position as shown in FIG. 10C. Once in the second position, the piston head 1028 no longer blocks fluid communication between the fluid communication lines 1050, 1052. Thus, fluid flow is no longer blocked between the inlet 1048 and the outlet 1049.

Furthermore, once in the second position, the first piston head 1027 is disposed in the second diameter portion 1005*b* of the first bore portion 1005 of bore 1004 and the one or more sealing members 1025 disposed about the outer circumference of the first piston head 1027 no longer seals against the bore 1004. The piston 1024 will not return to the first or intermediate positon by fluid pressure in the bore 1004 after moving to the second position because the first piston head 1027 is not in sealing engagement with the second diameter portion 1005*b* of the first bore portion 1005 of the bore 1004.

The switch 1020 is in the first configuration, as shown in FIG. 10A, when the piston 1024 is in the first position. Fluid communication between a fluid communication line 1050 and a fluid communication line 1052 is blocked when the switch 1020 is in the first configuration. The switch 1020 is in an intermediate configuration, as shown in FIG. 10B, when the piston 1024 is in the intermediate position after the shearable members 1026 fail. Fluid communication between the fluid communication lines 1050, 1052 is blocked when the switch 1020 is in the intermediate configuration. The switch 1020 is in the second configuration, as shown in FIG. 10C, when the piston 1024 is in the second position. Fluid communication between the fluid communication line 1050 and the fluid communication line 1052 is unblocked when the piston 1024 is in the second position. Thus, fluid communication between the inlet 1048 and the actuator 1010, via the fluid communication line 1054 extending from the outlet 1049 to the actuator 1010, is established when the switch 1020 is in the second configuration. Once the switch 1020 is in the second configuration, the actuator piston 1012 may be moved from the first position (see FIG. 10A) to the second position (see FIG. 10C) in response to fluid communication in the fluid communication line 1230. The actuator 1010 activates or actuates the second downhole tool 1220 when the actuator piston 1012 is in the second position.

The inlet 1048 is in communication with a first branch 1230*a* of the fluid communication line 1230. The fluid communication line 1230 is also in communication with a first downhole tool actuator 1211 of the first downhole tool 1210 via a second branch 1230*b* of the fluid communication line 1230. The first downhole tool actuator 1211 is configured to actuate or activate the first downhole tool 1210 in response to fluid communication in the second branch 1230*b* of the fluid communication line 1230. Thus, the switch 1020 is responsive to the fluid pressures in the fluid communication line 1230 via the inlet 1048. The switch 1020 of the switch assembly 1002 prevents the actuation or activation of the second downhole tool 1220 while the first downhole tool 1210 is being activated or actuated by the first downhole tool actuator 1211.

For example, the first downhole tool 1210 is activated or actuated by the first downhole tool actuator 1211 in response to a pressure in the fluid communication line 1230 that is higher than the pressure necessary to actuate or activate the second downhole tool 1220 with the actuator 1010. The shearable members 1026 are configured to shear in response to the pressure needed to operate the first downhole tool actuator 1211 to cause the actuation or activation of the first downhole tool 1210. The shearable members 1026 may be configured to shear at a pressure greater than necessary to operate the first downhole tool actuator 1211 to cause the actuation or activation of the first downhole tool 1210. Once the shearable members 1026 fail, the piston 1024 moves from the first position (FIG. 10A) to the intermediate position (FIG. 10B). The piston 1024 does not move to the second position because of the differential in piston head surface areas between the first piston head 1027 and the second piston head 1028. After the first downhole tool 1210 is actuated or activated by the first downhole tool actuator 1211, then pressure in the fluid communication line 1230, and thus the bore 1004, can be decreased below the biasing force of the biasing member 1029. As a result, the piston 1024 moves to the second position (FIG. 10C) to establish fluid communication between the first branch 1230*a* of the fluid communication line 1230 and the actuator 1010. When the piston 1024 is in the second position, fluid communication between the fluid communication line 1230 and the actuator 1010 is established. Thus, the actuator piston 1012 can then be moved in response to fluid communication in the fluid communication line 1230 to activate or actuate the second downhole tool 1220.

Figure 11B:
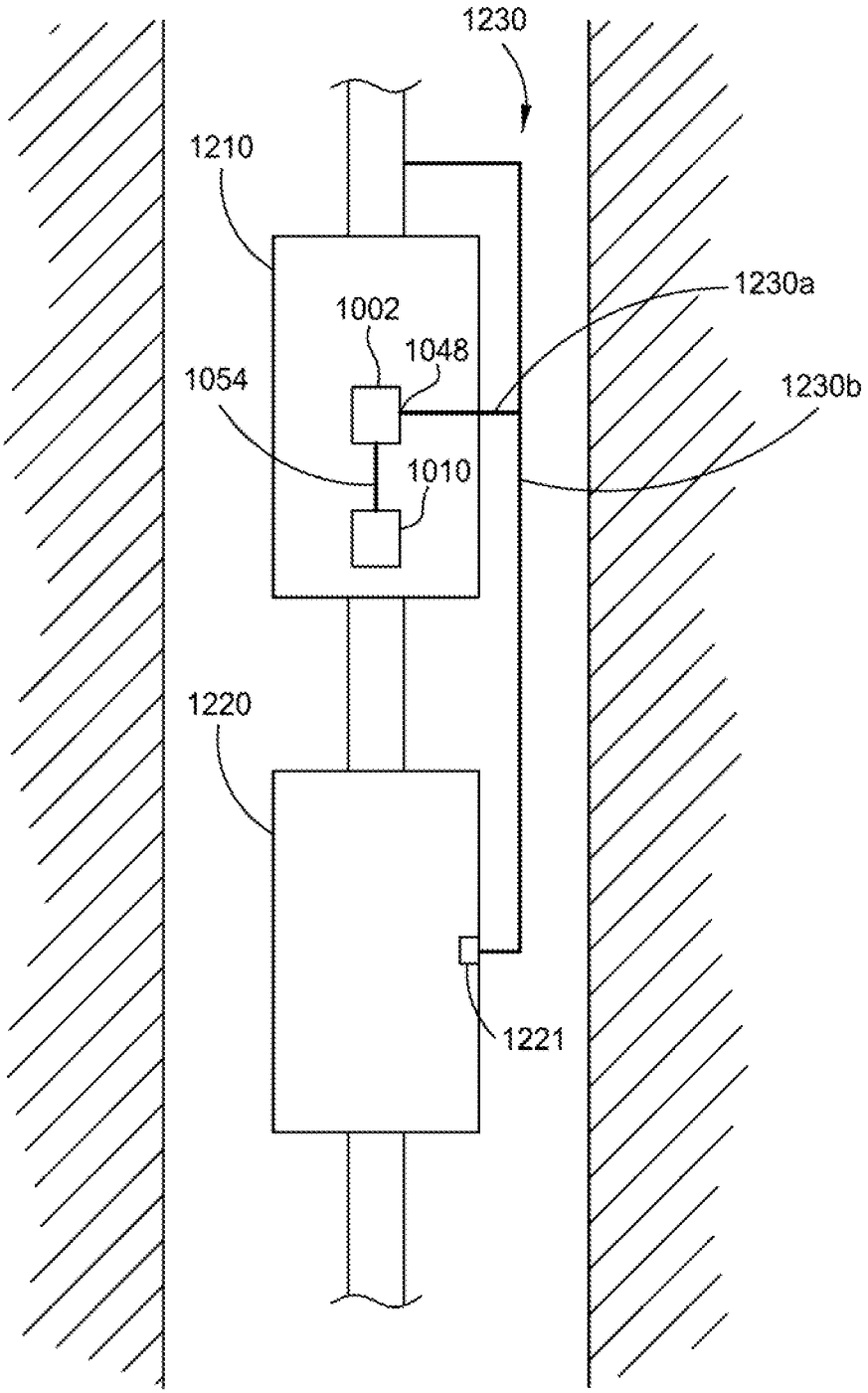
FIG. 11B illustrates the switch assembly of the downhole tool actuator assembly coupled to the first downhole tool and the actuator of the downhole tool actuator assembly coupled to the downhole tool.

In some embodiments, as shown in FIG. 11B, the switch assembly 1002 is incorporated into or disposed on a first downhole tool 1210 and the actuator 1010 is also incorporated into or disposed on the first downhole tool 1210. In this embodiment, the actuator 1010 is configured to activate or actuate the first downhole tool 1210 instead of the first downhole tool actuator 1211. The first downhole tool 1210 is coupled to the second downhole tool 1220. A second downhole tool actuator 1221 of the second downhole 1220 tool is configured to activate or actuate the second downhole tool 1220 in response to a pressure in the second branch 1230*b* of the fluid communication line 1230. The fluid communication line 1230 is also in communication with the inlet 1048 of the switch assembly 1002 via the first branch 1230*a* of the fluid communication line 1230. The switch 1020 of the switch assembly 1002 prevents fluid communication between the fluid communication line 1230 and the actuator 1010 while the second downhole tool 1220 is activated or actuated via the second downhole tool actuator 1221.

For example, the shearable members 1026 are configured to shear in response to the pressure in the fluid communication line 1230 needed to operate the second downhole tool actuator 1221 to cause the actuation or activation of the second downhole tool 1220. The shearable members 1026 may be configured to shear at a pressure greater than necessary to operate the second downhole tool actuator 1221 to cause the actuation or actuation of the second downhole tool 1220. Once the shearable members 1026 fail, the piston 1024 moves from the first position (FIG. 10A) to the intermediate position (FIG. 10B). The piston 1024 does not move to the second position because of the differential in piston head surface areas between the first piston head 1027 and the second piston head 1028. After the second downhole tool 1220 is actuated or activated by the second downhole tool actuator 1221, then pressure in the fluid communication line 1230, and thus pressure in the bore 1004, can be decreased below the biasing force of the biasing member 1029. As a result, the piston 1024 moves to the second position (FIG. 10C) to establish fluid communication between the fluid communication line 1230 and the actuator 1010. The actuator piston 1012 can then be moved in response fluid communication in the fluid communication line 1230 to activate or actuate the first downhole tool 1210.

In some embodiments, the switch assembly 1002 is not incorporated into or disposed on a first downhole tool, and is instead located on another downhole tool, such as a tubular sub, and is in fluid communication with the first downhole tool and the actuator 1010.

In some embodiments, the switch assembly 1002 has a second switch (not shown) similar to the first piston assembly 510 having the first piston 514. The second switch blocks fluid communication between the inlet 1048 and the switch 1020 when the second switch is in a first position. The second switch is movable from the first position to the second position in response to pressure communicated through the inlet 1048. Once the second switch is in the second position, fluid communication between the inlet 1048 and the outlet 1049 is still blocked by the switch 1020 until the piston 1024 moves to the second position. Instead of the first piston assembly 510, the second switch maybe a rupture disc may be disposed in the fluid communication line 1050 to initially block fluid communication between the inlet 1048 and the switch 1020 prior to the rupturing of the disc in response to an increase in pressure sufficient to rupture the disc.

In one or more embodiments, a latch release mechanism incudes a housing having a fluid inlet and an actuator piston at least partially disposed in the housing and movable from a first positon to a second position in response to fluid communication from the fluid inlet. The latch release mechanism further includes a latch member coupled to the actuator piston and movable from a first positon to a second position by the actuator piston. The latch release mechanism further includes a switch having a first configuration, a second configuration, and an intermediate configuration, wherein fluid communication is blocked when the switch is in the first configuration and the intermediate configuration, and wherein the fluid communication is unblocked when the switch is in the second configuration. The actuator piston is movable to the second position when the switch is in the second configuration.

In one or more embodiments, the switch comprises a piston assembly at least partially disposed in the housing, the piston assembly having a piston with a first piston head and a second piston head, wherein the first piston head has a greater piston surface area than a piston surface area of the second piston head.

In one or more embodiments, the piston has a first position corresponding to the first configuration of the switch, a second positon corresponding to the second configuration of the switch, and an intermediate position corresponding to an intermediate configuration of the switch.

In one or more embodiments, the latch member is adjustable in length.

In one or more embodiments, the switch is a second switch and the latch release mechanism further includes a first switch having a first configuration and a second configuration. Fluid communication is blocked when the first switch and second switch are both in their respective first configurations and wherein the fluid communication is unblocked when the first switch and the second switch are in their respective second configurations.

In one or more embodiments, the first switch is a first piston assembly having a first piston, and the second switch is a second piston assembly having a second piston. The second piston has a first piston head and a second piston head, wherein the first piston head has a greater piston surface area than a piston surface area of the second piston head.

In one or more embodiments, an assembly for use downhole includes an actuator and a switch assembly. The switch assembly has a housing having an inlet in selective fluid communication with the actuator, and a switch having a first configuration, an intermediate configuration, and a second configuration. The switch blocks fluid communication between the inlet and the actuator when in the first configuration and the intermediate configuration. The switch allows fluid communication between the inlet and the actuator when in the second configuration.

In one or more embodiments, the switch is a piston assembly with a piston having a first piston head and a second piston head, wherein the first piston head has a greater piston surface area than a piston surface area of the second piston head.

In one or more embodiments, the piston has a first position corresponding to the first configuration of the switch, a second position corresponding to the second configuration of the switch, and an intermediate position corresponding to the intermediate configuration of the switch.

In one or more embodiments, the switch is a first switch, and the switch assembly further includes a second switch having a first configuration and a second configuration, wherein the second switch moves from the first configuration to the second configuration prior to the switch converting to the second configuration.

In one or more embodiments, the first switch of the switch assembly is a first piston assembly and the second switch of the switch assembly is a second piston assembly.

In one or more embodiments, the actuator of the assembly for use downhole is incorporated into a first downhole tool and the switch assembly of the assembly for use downhole is incorporated into a second downhole tool.

In one or more embodiments, a bottom hole assembly includes a whipstock, a downhole tool having a lock mechanism, and a latch release mechanism attached to the whipstock and configured to releasably attach the whipstock to the downhole tool.

In one or more embodiments, the latch release mechanism of the bottom hole assembly includes an actuator piston movable from a first position to a second position in response to fluid communication. The latch release mechanism further includes a switch having a first configuration, a second configuration, and an intermediate configuration, wherein fluid communication is blocked when the switch is in the first configuration and the intermediate configuration, and wherein the fluid communication is unblocked when the switch is in the second configuration. The latch release mechanism further includes a latch member coupled to the piston and configured to engage the lock mechanism in a first positon and to disengage from the lock mechanism in a second position, wherein the latch member is movable from the first position to the second position by the actuator piston when the switch is in the second configuration.

In one or more embodiments, the switch of the latch release mechanism comprises a piston assembly having a piston with a first piston head and a second piston head, wherein the first piston head has a greater piston surface area than a piston surface area of the second piston head.

In one or more embodiments, the piston has a first position corresponding to the first configuration of the switch, a second positon corresponding to the second configuration of the switch, and an intermediate position corresponding to an intermediate configuration of the switch.

In one or more embodiments, the switch is a second switch and the latch release mechanism further includes a first switch having a first configuration and a second configuration, wherein the fluid communication is blocked when the first switch and second switch are both in their respective first configurations and wherein the fluid communication is unblocked when the first switch and the second switch are in their respective second configurations.

In one or more embodiments, the first switch is a first piston assembly having a first piston, and the second switch is a second piston assembly having a second piston with a first piston head and a second piston head, wherein the first piston head has a greater piston surface area than a piston surface area of the second piston head.

In one or more embodiments, a method of releasing a whipstock from a downhole tool includes running a bottom hole assembly having the whipstock releasably attached to the downhole tool into a wellbore, wherein the whipstock has a latch release mechanism and the downhole tool has a lock mechanism, and wherein a latch member of the latch release mechanism is engaged with a locking member of the lock mechanism. The method further includes converting a switch of the latch release mechanism from a first configuration to a second configuration to unblock a fluid communication between a fluid communication line and an actuator piston attached to the latch member. The method further includes releasing the whipstock from the downhole tool by moving the actuator piston coupled to the latch member to disengage the latch member from the locking member in response to the fluid communication in the fluid communication line.

In one or more embodiments, the method includes setting an anchor of the BHA by increasing pressure in the fluid communication line prior to converting the switch.

In one or more embodiments the method includes testing the anchor prior to moving the piston coupled to the latch member.

In one or more embodiments, the switch converts to an intermediate configuration prior to converting to the second configuration, wherein the fluid communication between the fluid communication line and the piston coupled to the latch member is blocked in the intermediate configuration.

In one or more embodiments, a collar is attached to the whipstock and disposed about a portion of the downhole tool, and wherein torque is transferred from the downhole tool to the whipstock via the collar.

In one or more embodiments, the bottom hole assembly includes a whipstock having a latch release mechanism, a milling tool having a plurality of blades and a lock mechanism, and a collar coupled to the whipstock and disposed about a portion of the milling tool, wherein the blades of the milling tool abut the collar. The milling tool is releasably coupled to the whipstock by the interaction of the latch release mechanism and the lock mechanism.

In one or more embodiments, the collar has a plurality of apertures and the milling tool has a plurality of recesses. The bottom hole assembly further includes and a plurality of torque keys, wherein each torque key is at least partially disposed in a corresponding aperture and recess, and wherein the torque keys are configured to allow the transfer of torque from the milling tool to the whipstock.

In one or more embodiments, the latch release mechanism includes an actuator piston movable from a first position to a second position in response to fluid communication. The latch release mechanism further includes a switch having a first configuration, a second configuration, and an intermediate configuration, wherein fluid communication is blocked when the switch is in the first configuration and the intermediate configuration, and wherein the fluid communication is unblocked when the switch is in the second configuration. The latch release mechanism further includes a latch member coupled to the piston and configured to engage the lock mechanism in a first positon and to disengage from the lock mechanism in a second position, wherein the latch member is movable from the first position to the second position by the actuator piston when the switch is in the second configuration.

In one or more embodiments, the switch of the latch release mechanism comprises a piston assembly having a piston with a first piston head and a second piston head, wherein the first piston head has a greater piston surface area than a piston surface area of the second piston head.

In one or more embodiments, the switch of the latch release mechanism is a piston and the piston has a first position corresponding to the first configuration of the switch, a second positon corresponding to the second configuration of the switch, and an intermediate position corresponding to an intermediate configuration of the switch.

In one or more embodiments, the switch is a second switch. The latch release mechanism further includes a first switch having a first configuration and a second configuration, wherein the fluid communication is blocked when the first switch and second switch are both in their respective first configurations and wherein the fluid communication is unblocked when the first switch and the second switch are in their respective second configurations.

In one or more embodiments, the latch release mechanism has a first and second switch. The first switch is a first piston assembly having a first piston, and the second switch is a second piston assembly having a second piston with a first piston head and a second piston head, wherein the first piston head has a greater piston surface area than a piston surface area of the second piston head.

In one or more embodiments, a bottom hole assembly has a milling tool having a lock mechanism, a whipstock, and anchor. The bottom hole assembly has a latch release mechanism having a tubular connection mechanism disposed between the whipstock and anchor and a latch actuator. The tubular connection mechanism has a tubular sub having a bore therethrough a valve assembly. The valve assembly has a first valve member having an inlet port and an outlet port, and a second valve member movable from a first position to a second position, the second valve member having a first sealing region and a second sealing region, wherein when the second valve member is in the first position, the first sealing region prevents fluid communication between the inlet port and the outlet port, and wherein when the second valve member is in the second position, the second sealing region allows fluid communication between the inlet port and the outlet port. The latch actuator is coupled to the whipstock and in selective fluid communication with the inlet port. The latch actuator has an actuator piston movable from a first position to a second position in response to fluid communication when the second valve member is in the second position, and a latch member coupled to the piston and movable by the actuator piston from a first position where the latch member is engaged with the lock mechanism to a second position where the latch member is disengage from the lock mechanism.

In one or more embodiments, the bottom hole assembly also has a collar attached to the whipstock, wherein the downhole tool is engaged with the collar when the latch member is in a first position.

In one or more embodiments, the collar has a plurality of apertures and the milling tool has a plurality of recesses. A plurality of torque keys is at least partially disposed in a corresponding aperture and recess.

In one or more embodiments, the collar has a plurality of apertures and the downhole tool has a plurality of recesses. A plurality of torque keys is at least partially disposed in a corresponding aperture and recess.

In one or more embodiments, a biasing member is disposed between a first end of the second valve member and the first valve member, wherein the biasing member is configured to bias the second valve member in the first position.

In one or more embodiments, the latch release mechanism includes a tubular connection mechanism having a tubular sub having a bore therethrough and a valve assembly. The valve assembly has a first valve member having an inlet port and an outlet port. The valve assembly also has a second valve member movable from a first position to a second position and having a first sealing region and a second sealing region. When the second valve member is in the first position, the first sealing region prevents fluid communication between the inlet port and the outlet port. When the second valve member is in the second position, the second sealing region allows fluid communication between the inlet port and the outlet port.

In one or more embodiments, the latch release mechanism includes a latch actuator in selective fluid communication with the inlet port, having a housing, an actuator piston at least partially disposed in the housing and movable in response to fluid communication from the inlet port, and a latch member coupled to the piston and movable from a first position to a second position by the actuator piston.

In one or more embodiments, the latch release mechanism includes a biasing member disposed between a first end of the second valve member and the first valve member, and the biasing member is configured to bias the second valve member in the first position.

In one or more embodiments, the latch actuator is attached to a whipstock and the connection mechanism is disposed between an anchor and the whipstock.

In one or more embodiments, a collar is attached to the whipstock and abuts a milling tool.

In one or more embodiments, a plurality of torque keys are partially disposed in recesses in the milling tool and corresponding apertures in the collar.

In one or more embodiments, a collar is attached to the whipstock and abuts a downhole tool.

The invention claimed is:

1. A bottom hole assembly (BHA), comprising:

a whipstock including a latch release mechanism;

a milling tool including a plurality of blades and a lock mechanism; and a collar coupled to a first end of the whipstock, the collar and the first end of the whipstock define an opening, wherein a portion of the milling tool is disposed in the opening and the blades of the milling tool abut the collar;

wherein the milling tool is releasably coupled to the whipstock by the interaction of the latch release mechanism and the lock mechanism.

2. The BHA of claim 1, further comprising:

the collar has a plurality of apertures;

the milling tool has a plurality of recesses; and a plurality of torque keys, wherein each torque key is at least partially disposed in a corresponding aperture and recess, and wherein the torque keys are configured to allow torque transfer from the milling tool to the whipstock.

3. The BHA of claim 1, the latch release mechanism further comprising:

an actuator piston movable from a first position to a second position in response to fluid communication;

a switch including a first configuration, a second configuration, and an intermediate configuration, wherein fluid communication is blocked when the switch is in the first configuration and the intermediate configuration, and wherein the fluid communication is unblocked when the switch is in the second configuration;

a latch member coupled to the piston and configured to engage the lock mechanism in a first position and to disengage from the lock mechanism in a second position, wherein the latch member is movable from the first position to the second position by the actuator piston when the switch is in the second configuration.

4. The BHA of claim 3, wherein the switch comprises a piston assembly including a piston with a first piston head and a second piston head, wherein the first piston head has a greater piston surface area than a piston surface area of the second piston head.

5. The BHA of claim 4, wherein the piston has a first position corresponding to the first configuration of the switch, a second position corresponding to the second configuration of the switch, and an intermediate position corresponding to an intermediate configuration of the switch.

6. The BHA of claim 4, further comprising:

wherein the switch is a second switch; and a first switch including a first configuration and a second configuration, wherein the fluid communication is blocked when the first switch and second switch are both in their respective first configurations and wherein the fluid communication is unblocked when the first switch and the second switch are in their respective second configurations.

7. The BHA of claim 6, wherein the first switch is a first piston assembly including a first piston, and the second switch is a second piston assembly including a second piston with a first piston head and a second piston head, wherein the first piston head has a greater piston surface area than a piston surface area of the second piston head.

8. The BHA of claim 3, wherein the latch member is adjustable in length.

9. The BHA of claim 3, wherein the latch member is disposed in a channel formed on an outer surface of the whipstock.

10. The BHA of claim 3, wherein the actuator piston is disposed in an aperture formed in the whipstock, and wherein the extension of the actuator piston is limited by a wall of the aperture.

11. The BHA of claim 1, further comprising:

an anchor;

the latch release mechanism, further comprising:

a tubular connection mechanism disposed between the whipstock and anchor, the tubular connection mechanism including:

a tubular sub including a bore therethrough;

a valve assembly including:

a first valve member including an inlet port and an outlet port; and a second valve member movable from a first position to a second position, the second valve member including a first sealing region and a second sealing region, wherein when the second valve member is in the first position, the first sealing region prevents fluid communication between the inlet port and the outlet port, and wherein when the second valve member is in the second position, the second sealing region allows fluid communication between the inlet port and the outlet port;

a latch actuator coupled to the whipstock and in selective fluid communication with the inlet port, including:

an actuator piston movable from a first position to a second position in response to fluid communication when the second valve member is in the second position;

a latch member coupled to the piston and movable by the actuator piston from a first position where the latch member is engaged with the lock mechanism to a second position where the latch member is disengaged from the lock mechanism.

12. The BHA of claim 11, wherein the latch member is adjustable in length.

13. The BHA of claim 1, the latch release mechanism comprising:

a tubular sub including a bore therethrough; and a valve assembly including:

a first valve member including an inlet port and an outlet port; and a second valve member movable from a first position to a second position, the second valve member including a first sealing region and a second sealing region, wherein when the second valve member is in the first position, the first sealing region prevents fluid communication between the inlet port and the outlet port, and wherein when the second valve member is in the second position, the second sealing region allows fluid communication between the inlet port and the outlet port; and a latch actuator in selective fluid communication with the inlet port, including:

a housing;

an actuator piston at least partially disposed in the housing and movable in response to fluid communication from the inlet port; and a latch member coupled to the piston and movable from a first position to a second position by the actuator piston, wherein the latch member interacts with the locking mechanism in the first position.

14. The BHA of claim 13, further comprising:

a biasing member disposed between a first end of the second valve member and the first valve member, wherein the biasing member is configured to bias the second valve member in the first position.

15. The BHA of claim 13, wherein the latch actuator is attached to a whipstock and the tubular is disposed between an anchor and the whipstock, and wherein the second valve member is moveable from the first position to the second position in response to contact with the anchor.

16. The BHA of claim 1, wherein the latch release mechanism is at least partially disposed in an aperture formed in the whipstock.

17. A bottom hole assembly (BHA), comprising:

a milling tool including a plurality of blades and a lock mechanism;

a whipstock including a latch release mechanism;

wherein the latch release mechanism further comprises:

a switch including:

a first configuration, a second configuration, and an intermediate configuration, wherein fluid communication is blocked when the switch is in the first configuration and the intermediate configuration, and wherein the fluid communication is unblocked when the switch is in the second configuration; and a piston assembly including a piston with a first piston head and a second piston head, wherein the first piston head has a greater piston surface area than a piston surface area of the second piston head;

an actuator piston movable from a first position to a second position in response to fluid communication;

a latch member coupled to the piston and configured to engage the lock mechanism in a first position and to disengage from the lock mechanism in a second position, wherein the latch member is movable from the first position to the second position by the actuator piston when the switch is in the second configuration; and a collar coupled to the whipstock and disposed about a portion of the milling tool, wherein the blades of the milling tool abut the collar.

18. The BHA of claim 17, wherein the piston has a first position corresponding to the first configuration of the switch, a second position corresponding to the second configuration of the switch, and an intermediate position corresponding to an intermediate configuration of the switch.

19. A bottom hole assembly (BHA), comprising:

a milling tool including a plurality of blades and a lock mechanism;

a whipstock including a latch release mechanism; wherein, the latch release mechanism comprises:

a tubular sub including a bore therethrough; and a valve assembly including:

a first valve member including an inlet port and an outlet port; and a second valve member movable from a first position to a second position, the second valve member including a first sealing region and a second sealing region, wherein when the second valve member is in the first position, the first sealing region prevents fluid communication between the inlet port and the outlet port, and wherein when the second valve member is in the second position, the second sealing region allows fluid communication between the inlet port and the outlet port; and a latch actuator in selective fluid communication with the inlet port, including:

a housing;

an actuator piston at least partially disposed in the housing and movable in response to fluid communication from the inlet port; and a latch member coupled to the piston and movable from a first position to a second position by the actuator piston, wherein the latch member interacts with the lock mechanism in the first position; and a collar coupled to the whipstock and disposed about a portion of the milling tool, wherein the blades of the milling tool abut the collar;

wherein the milling tool is releasably coupled to the whipstock by the interaction of the latch member and the lock mechanism with the lock mechanism in the first position.

20. The BHA of claim 19, further comprising:

a biasing member disposed between a first end of the second valve member and the first valve member, wherein the biasing member is configured to bias the second valve member in the first position.

* * * * *